United States Patent [19]

Yamada et al.

[11] Patent Number: 4,777,123

[45] Date of Patent: Oct. 11, 1988

[54] LIGHT-SENSITIVE SILVER HALIDE COLOR PHOTOGRAPHIC MATERIAL

[75] Inventors: Yoshitaka Yamada; Hiroshi Shimazaki; Toshifumi Iijima, all of Hino, Japan

[73] Assignee: Konishiroku Photo Industry Co., Ltd., Tokyo, Japan

[21] Appl. No.: 854,199

[22] Filed: Apr. 21, 1986

[30] Foreign Application Priority Data

Apr. 24, 1985 [JP] Japan ..... 60-88394

[51] Int. Cl.[4] ..... G03C 1/46; G03C 7/26; G03C 7/32; G03C 1/02

[52] U.S. Cl. ..... 430/505; 430/552; 430/553; 430/556; 430/557; 430/558; 430/567

[58] Field of Search ..... 430/505, 558, 552, 553, 430/556, 557, 567

[56] References Cited

U.S. PATENT DOCUMENTS

| | | | |
|---|---|---|---|
| 3,725,067 | 4/1973 | Bailey et al. | 430/558 |
| 4,203,768 | 5/1980 | Inouye et al. | 430/338 |
| 4,326,024 | 4/1982 | Kobayashi et al. | 430/557 |
| 4,333,999 | 6/1982 | Lau | 430/17 |
| 4,427,767 | 1/1984 | Aoki et al. | 430/552 |
| 4,434,225 | 2/1984 | Sugita et al. | 430/544 |
| 4,451,559 | 5/1984 | Sato et al. | 430/552 |
| 4,536,472 | 8/1985 | Kato et al. | 430/505 |

FOREIGN PATENT DOCUMENTS

| | | | |
|---|---|---|---|
| 0177765 | 4/1984 | European Pat. Off. | 430/558 |
| 78831 | 6/1981 | Japan . | |

*Primary Examiner*—Paul R. Michl
*Assistant Examiner*—Lee C. Wright
*Attorney, Agent, or Firm*—Frishauf, Holtz, Goodman & Woodward

[57] ABSTRACT

Disclosed is a light-sensitive silver halide color photographic material comprising a light-sensitive multi-layer color photographic material having at least each one layer of blue-sensitive layer, green-sensitive layer and red-sensitive layer on a support, wherein;

at least one blue-sensitive layer contains at least one kind of benzoyl type couplers, at least one green-sensitive layer contains at least one kind of pyrazoloazole type couplers, and at least one red-sensitive layer contains at least one kind of ureido type couplers.

According to this invention, it is possible to obtain a light-sensitive material which has broad exposure latitude and is excellent in gradation characteristic, or a light-sensitive material which has broad exposure latitude and is excellent in graininess, or a light-sensitive material which has broad exposure latitude, is excellent in graininess and also good in a desilverization performance during processing.

24 Claims, No Drawings

LIGHT-SENSITIVE SILVER HALIDE COLOR PHOTOGRAPHIC MATERIAL

BACKGROUND OF THE INVENTION

This invention relates to a light-sensitive silver halide color photographic material. Particularly, it relates to a light-sensitive color photographic material having broad exposure latitude, excellent in gradation and graininess and also good in desilverization performance during processing.

Light-sensitive material (abbreviated for light-sensitive silver halide color photographic material, hereinafter the same), when this is subjected to imagewise exposure, is required to form an imagewise image with an appropriate degree of shade of the negative of the light-sensitive material corresponding to lightness and darkness of the object to be photographed, even when there may be excess or shortage of exposure. Light-sensitive material with broad latitude to cope with such excess or shortage of exposure have been strongly demanded. Practically, however, increased exposure will result in poor graininess and sharpness, and this poses a general problem in light-sensitive materials.

For example, in order to obtain a light-sensitive material with broad exposure latitude, it has been proposed in the prior art to constitute a light-sensitive material by use of a silver halide emulsion with broad grain size distribution, or to constitute a light-sensitive material by use of a silver iodobromide emulsion having a high iodide content, or to reduce the silver quantity of the silver halide in the silver halide emulsion to be used for the light-sensitive material. However, according to any of these techniques, graininess is deteriorated greatly, and there also remains the problem of lowering in sensitivity of the light-sensitive material.

There is also provided a technique which attempts to broaden exposure latitude of the light-sensitive material without deterioration of graininess. For example, there is disclosed the method in which the light-sensitive material is constituted by use of a mixture of several kinds of silver halide emulsions with different mean grain sizes, but the improved effect of exposure latitude was not satisfactory.

Further, another technique is also disclosed, in which the above silver halide emulsions are emulsions comprising silver halide grains having mono-dispersibility, and the light-sensitive material is constituted by use of a mixture of several kinds of these emulsions. For example, Japanese Unexamined Patent Publication No. 78831/1981 has accomplished broadened exposure latitude by use of several kinds of silver halide emulsions having substantially the same grain sizes with different iodide contents in the surface layer of the mono-dispersed silver halide grains. However, according to this method, the improved effect of graininess was not satisfactorily great.

On the other hand, in negative light-sensitive materials, disclosures has been made about the method in which color formed density of the image is lowered by use of a non-diffusible compound capable of releasing a diffusive development inhibiting compound through the reaction with the oxidized product of a developing agent (DIR compound) or about the method in which the color formed density of the image is similarly lowered by use of a coupler having multi-equivalence. In these techniques, more silver halide is necessary for compensating the gradation of the light-sensitive material, which is very disadvantageous in aspect of conservation of resources and cost, and further in aspect of deterioration of desilverization performance during processing.

However, in order to satisfy the performances particularly demanded for the color light-sensitive materials in recent years, namely the requirements of higher image quality and higher sensitivity, in spite of the disadvantages as mentioned above, the amount of silver halide used tends to be increased, and it has been desired to have a technique which improves latitude of exposure and graininess, and further a technique to improve desilverization performance.

SUMMARY OF THE INVENTION

Accordingly, a first object of this invention is to provide a light-sensitive material having broad exposure latitude and excellent in gradation.

Also, a second object of this invention is to provide a light-sensitive material having broad exposure latitude and excellent in graininess.

Further, a third object of this invention is to provide a light-sensitive material having broad exposure latitude, excellent in graininess and also good in desilverization performance during processing.

These objects can be accomplished by a light-sensitive multi-layer color photographic material having on a support at least each one layer of blue-sensitive layer, green-sensitive layer and red-sensitive layer, which is constituted of at least one blue-sensitive layer containing at least one kind of benzoyl type couplers, at least one green-sensitive layer containing at least one kind of pyrazoloazole type couplers and at least one red-sensitive layer containing at least one kind of ureido type cyan couplers.

DESCRIPTION OF THE PREFERRED EMBODIMENTS

In the light-sensitive silver halide color photographic material of this invention, each of the red-sensitive silver halide emulsion layer (hereinafter silver halide emulsion layer is called merely as emulsion layer), the green-sensitive emulsion layer and blue-sensitive emulsion layer constituting its red-sensitive layer, green-sensitive layer and blue-sensitive layer may be a single layer, but each layer should preferably consist of a plural number of emulsion layers, more preferably consisting of 2 or 3 layers. However, the blue-sensitive emulsion layer may consist only of 1 layer to give good results since the characteristic of naked eyes is inferior in sensitivity to its graininess.

When the emulsion layer having the same light-sensitivity consists of a plural number, said plural number of emulsion layers have different sensitivities and it is preferable that the layer should be lower in sensitivity as it is nearer to the support. When said plural number of layers consist of two layers, the sensitivity difference between the high sensitive light-sensitive layer and the low sensitive light-sensitive layer should preferably be 0.2 to 2.0 log E (E; dose of exposure), more preferably 0.4 to 1.0 log E.

When said plural number of layers consist of 3 layers, they consist of high sensitive light-sensitive layer, medium sensitive light-sensitive layer and low sensitive light-sensitive layer, and the sensitivity difference between the high sensitive light-sensitive layer and the medium sensitive light-sensitive layer should preferably be 0.2 to 1.0 logE, while the sensitivity difference between the medium sensitivity light-sensitive layer and the low sensitive light-sensitive layer preferably 0.2 to 1.0 logE.

Specific examples of preferable layer orders of the above emulsion layers are shown below. In the following description, the respective blue-sensitive, green-sensitive and red-sensitive layers are abbreviated as B, G and R, and the respective high sensitive, medium sensitive and low sensitive emulsion layers as H, M and L (for example, BH shows a high sensitive blue-sensitive silver halide emulsion layer). Further, yellow filter layer as represented by colloidal silver is abbreviated as YF, the intermediate layer as IL, the support (provided by coating with halation preventive layer) as BS and the protective layer as PR.

(1) PR, BH, BL, YF, GH, GL, IL, RH, RL, BS
(2) PR, BH, BL, YF, GH, GM, GL, IL, RH, RM, RL, BS
(3) PR, BH, BM, BL, YF, GH, GM, GL, IL, RH, RM, RL, BS
(4) PR, BH, IL, BL, YF, GH, GM, GL, IL, RH, RM, RL, RL, BS
(5) PR, BH, IL, BM, BL, YF, GH, GM, GL, IL, RH, RM, RL, BS
(6) PR, BH, BL, YF, GH, IL, RH, IL, GL, IL, RL, BS
(7) PR, BH, BL, IL, GH, IL, RH, IL, GL, IL, RL, BS
(8) PR, BH, BL, IL, GH, IL, RH, IL, GL, IL, RM, RL, BS
(9) PR, BH, BL, YF, GH, IL, RH, IL, GM, GL, IL, RM, RL, BS
(10) PR, BH, IL, GH, IL, RH, IL, BL, IL, GL, IL, RL, BS
(11) PR, BH, IL, GH, IL, BL, IL, RH, IL, GL, IL, RL, BS

Here, IL, particularly the IL adjacent to a high sensitive emulsion layer should contain a scavenger (a substance which prevents diffusion of the oxidized product of a color developing agent into the adjacent emulsion layer). Also, as disclosed in Japanese Patent Application No. 90571/1984 and Japanese Unexamined Patent Publication No. 160135/1984, non-light-sensitive microparticulate silver halide may also be contained in BH and/or the layer adjacent to said layer. In this case, said microparticulate silver halide should preferably have a mean grain size of 0.5 to 0.03 μm, more preferably 0.4 to 0.05 μm. Further, grains with a relationship of $S/\bar{r} \leqq 0.20$ between the mean grain size $\bar{r}$ and the standard deviation S of its distribution curve are preferred, more preferably $S/\bar{r} \leqq 0.15$.

The halogen composition in said microparticulate silver halide should preferably be silver idobromide, and its amount added should preferably be 10 to 0.5 $mgAg/dm^2$, more preferably 5 to 2 $mgAg/dm^2$.

In the layers adjacent to PR, BS layer, YF it is also preferable to add further one layer of gelatin, if desired.

In the light-sensitive silver halide color photographic material of this invention, the blue-sensitive emulsion layer constituting at least one layer of its blue-sensitive layer contains at least one kind of benzoyl type yellow color forming couplers, the green-sensitive emulsion layer constituting at least one layer of the green-sensitive layer contains at least one kind of pyrazoloazole type magenta color forming couplers and the red-sensitive emulsion layer constituting at least one layer of the red-sensitive layer contains at least one kind of ureido type cyan color forming couplers.

In this invention, an amount of each of the above benzoyl type yellow color forming coupler, the pyrazoloazole type magenta color forming coupler and the ureido type cyane color forming coupler is not limited, but it may be about $2\times10^{-3}$ to $5\times10^{-1}$ mol, preferably $1\times10^{-2}$ to $5\times10^{-1}$ mol per 1 mol of the light-sensitive silver halide contained in the emulsion layer.

More preferably, it is contained at a level of $1\times10^{-2}$ to $1\times10^{-1}$ mol per 1 mol of the silver halide in the high sensitive layer, $1\times10^{-2}$ to $1\times10^{-1}$ mol in the medium sensitive of layer and $2\times10^{-2}$ to $2\times10^{-1}$ mol in the low sensitive layer.

Particularly preferably, its amount is $1\times10^{-2}$ to $5\times10^{-2}$ mol per 1 mol of silver halide in the high sensitive layer, $2\times10^{-2}$ to $5\times10^{-2}$ mol in the medium sensitive layer and $3\times10^{-2}$ to $1\times10^{-1}$ mol in the low sensitive layer. In this case, even the coupler used may be relatively smaller in amount, there is the advantage that broad latitude can be obtained, whereby the light-sensitive material can be advantageously made thinner.

Also, with respect to high sensitivity and high color forming characteristic, it is preferable to use the so called di-equivalent coupler.

Further, in this invention, color forming couplers other than those couplers mentioned above can be used in combination. However, in order to have the effect of the invention fully exhibited, it is preferable that at least 50% of the total couplers contained in the same color-sensitive layer should be constituted of the above couplers of this invention. More preferably, 80% or more of the couplers of this invention should be contained. The above couplers of this invention may be used in either the high sensitive layer or the low sensitive layer. Preferably, they should be used in the low sensitive layer, and marked improved effect can be obtained if the color forming couplers in the respective layers of high sensitive, low sensitive and optionally medium sensitive layers are all constituted of the couplers according to this invention.

Even when the emulsion contained in the low sensitive layer may consist only of one kind, the effect of this invention is great.

Although it has been difficult in the prior art to improve graininess for obtaining broad latitude, it has been rendered possible by the constitution of this invention to provide a light-sensitive material having high graininess and broad latitude and being also good in processing stability.

Next, the couplers of this invention are to be described.

As the benzoyl type coupler of this invention, the couplers for forming yellow dye images represented by the following formula [I] can be preferably used.

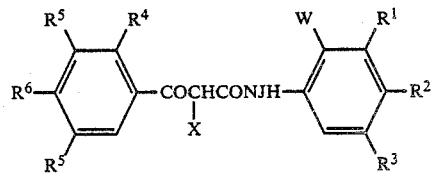

Formula [I]

In the formula, $R^1$, $R^2$ and $R^3$ may be either the same or different, and each represents a hydrogen atom, a halogen atom (e.g. fluorine, chlorine, bromine atom, etc.), an alkyl group (e.g. methyl, ethyl, allyl, dodecyl groups, etc.), an aryl group (e.g. phenyl, naphthyl groups, etc.), an alkoxy group (e.g. methoxy, ethoxy, dodecyloxy groups, etc.), an acylamino group (e.g. acetamide, α(p-dodecyloxyphenoxy)butaneamide groups, etc.), a carbamoyl group (e.g. carbamoyl, N, N-dimethylcarbamoyl, N-δ-(2.4-di-tert-amylphenoxy), butylcarbamoyl groups, etc.), an alkoxycarbonyl group (e.g. ethoxycarbonyl, dodecyloxycarbonyl, α(-dodecyloxycarbonyl)ethoxycarbonyl groups, etc.), a sulfonamide group (e.g. methanesulfonamide, p-dodecyloxybenzenesulfonamide, N-benzyldodecanesulfonamide groups, etc.), or a sulfamoyl group (e.g. sulfamoyl, N-methylsulfamoyl, N-δ-(2.4-di-tert-amylphenoxy)butylsulfamoyl, N,N-diethylsulfamoyl groups, etc.).

$R^4$, $R^5$, $R^6$ and $R^7$ may be either the same or different, and each represents a hydrogen atom, an alkyl group (e.g. methyl, ethyl, tert-butyl groups, etc.), an alkoxy group (e.g. methoxy, ethoxy, propoxy, octxy, groups, etc.), an aryloxy group (e.g. phenoxymethylphenoxy groups, etc.), an acylamino group (e.g. acetamide, α-(2.4-di-tert-amylphenoxy)butaneamide groups, etc.), or a sulfonamide group (e.g. methanesulfonamide, p-dodecylbenzenesulfonamide, N-benzyldodecansulfonamide groups, etc.).

W represents a halogen atom (e.g. fluorine, chlorine, bromine, atom, etc.), an alkyl group (e.g. methyl, ethyl, tert-butyl groups etc.), an alkoxy group (e.g. methoxy, ethoxy, propoxy, octoxy groups, etc.), an aryloxy group (e.g. phenoxy, methylphenoxy, etc.) or a dialkylamino group (e.g. dimethylamino, N-butyl-N-octylamino groups, etc.).

X represents a hydrogen atom or an eliminable group. Preferable groups as the eliminable group are represented by the formula [II].

Formula [II]

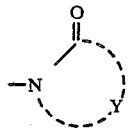

Y represents a group of non-metal atoms necessary for formation of a 5- to 6-membered ring. (Examples of the cyclic compounds formed represent respective derivatives such as 2,5-dioxoimidazoline, 2,5-pyrrolidinedione, 1,3-isoindoledione, 2,3,5-trioxoimidazolidine, 2,5-dioxotriazolidine, 2,4-oxazoridinedione, 2,4-thiazolidinedione, 2(1H)-pyridone, 2(1H)-pyrimidone, 2(1H)-pyrazone, 5(1H)-imidazolone, 5(1H)-triazolone, 2(1H)-pyrimidone, 2-pyrazolone(5), 2-isothiazoline(5), 2(1H)-quinaoxazolone, 4(3H)-pyrimidone, 2-benzoxazolone, 4-isooxazolone(5), 3-furolone(2), 4-imidazolone(2), 3-pyrazoline, 2-tetrazolone(5), 3-tetrazolone(5)).

Specific examples of the yellow coupler represented by the formula [I] are set forth below.

[Y-1]

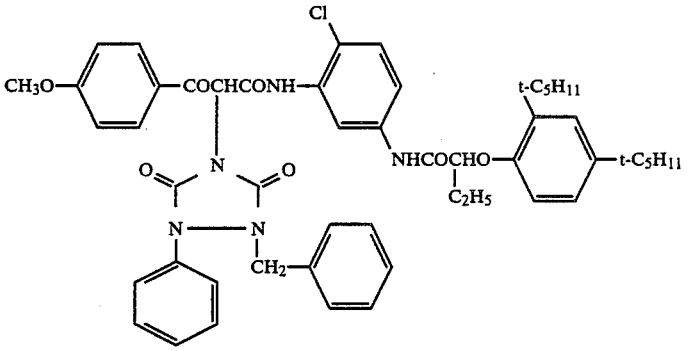

[Y-2]

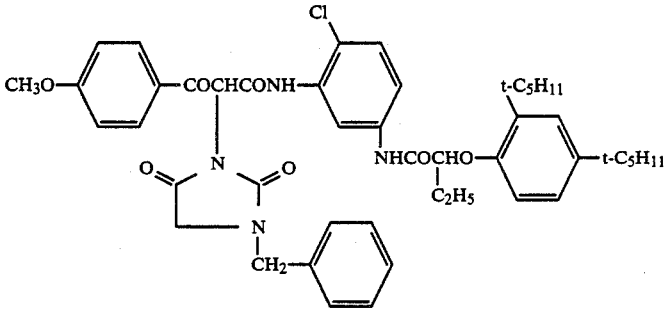

[Y-3]

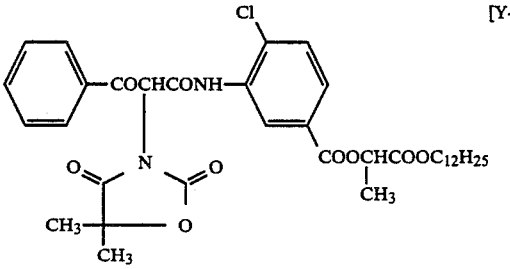

[Y-4]

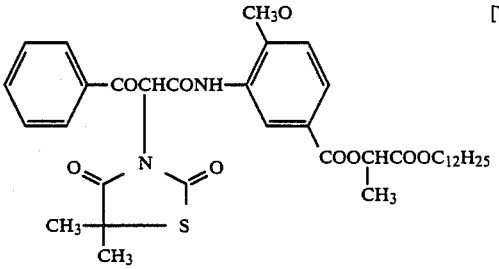

-continued
[Y-5]
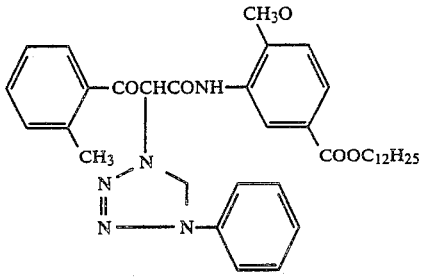
[Y-6]
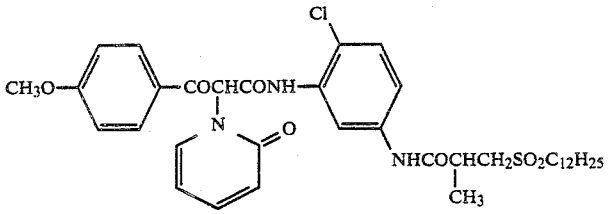
[Y-7]
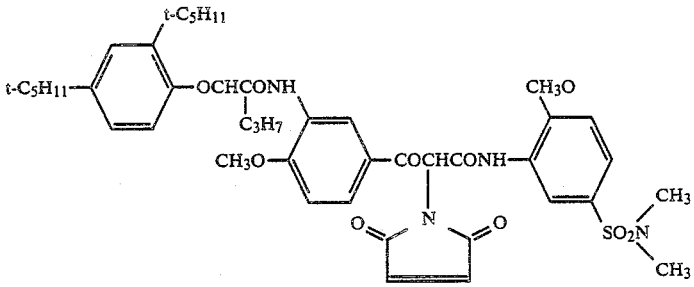
[Y-8]
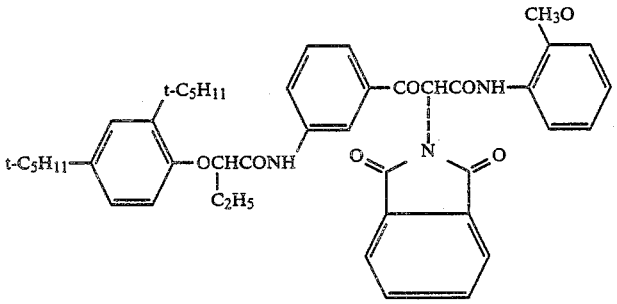
[Y-9]
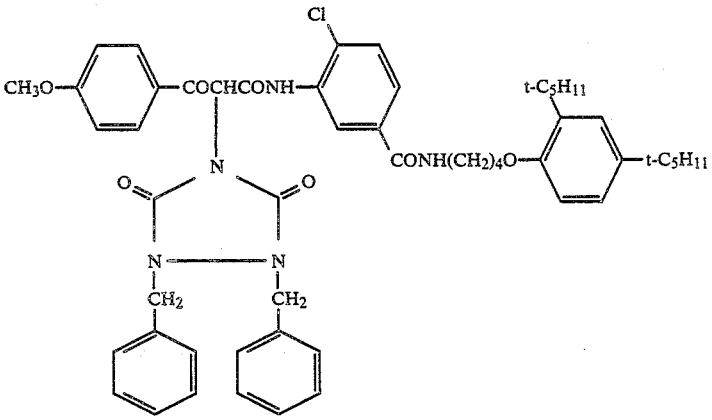

-continued

[Y-10]

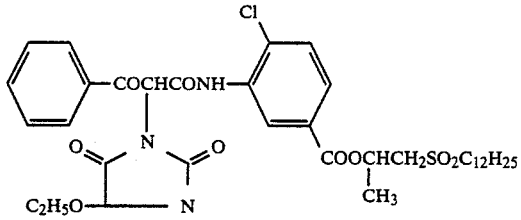

[Y-11]

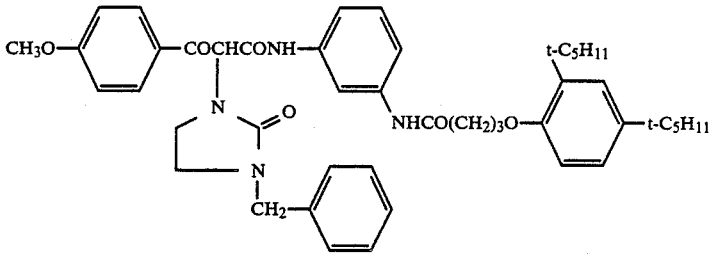

[Y-12]

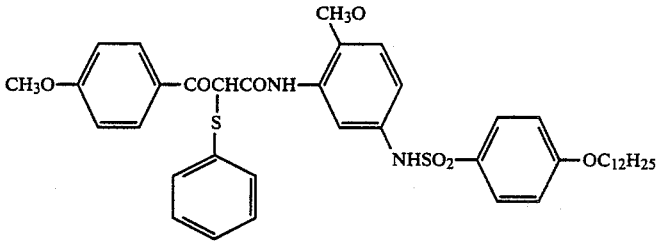

[Y-13]

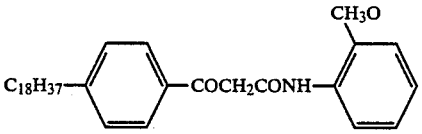

[Y-14]

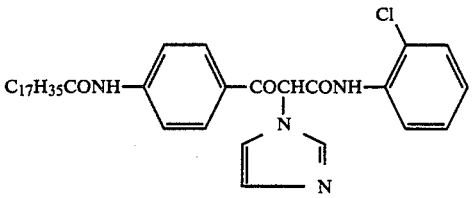

[Y-15]

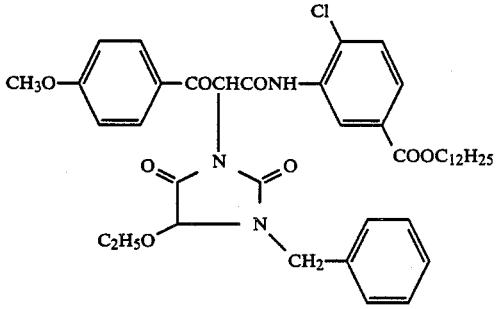

Next, as the pyrazolotriazole type coupler of this invention, the couplers for forming magenta dye images represented by the following formula [III] can be preferably used.

Formula [III]

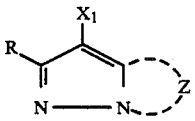

wherein Z represents a group of non-metal atoms necessary for formation of a nitrogen-containing heterocyclic ring, the ring formed by said Z may have a substituent; $X_1$ represents a hydrogen atom or a substituent eliminable through the reaction with the oxidized product of a color developing agent; and R represents a hydrogen atom or a substituent.

The magenta coupler to be used in this invention represented by the above formula [III] (hereinafter referred to as the magenta coupler of the present invention) is explained below.

Examples of the substituent represented by R in the above formula [III] include a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residue, a bridged hydrocarbon compound residue, an alkoxy group, an aryloxy group, heterocyclicoxy group, a siloxy group, an acyloxy group, a carbamoyloxy group, an amino group, an acylamino group, a sulfonamide group, an imido group, an ureido group, a sulfamoylamino group, an alkoxycarbonylamino group, an aryloxycarbonylamino group, an alkoxycarbonyl group, an aryloxycarbonyl group, an alkylthio group, an arylthio group, a heterocyclicthio group, etc.

The halogen atom may be, for example, a chlorine atom or a bromine atom, particularly preferably chlorine atom.

The alkyl group represented by R may preferably one having 1 to 32 carbon atoms; the alkenyl group, alkynyl group preferably those having 2 to 32 carbon atoms; the cycloalkyl group, cycloalkenyl groups preferably those having 3 to 12, particularly preferably 5 to 7 carbon atoms; the alkyl, alkenyl and alkynyl groups being either straight or branched.

Also, these alkyl, alkenyl, alkynyl, cycloalkyl and cycloalkenyl groups may have substituents [e.g. aryl, cyano, halogen atom, heterocyclic, cycloalkyl, cycloalkenyl, spiro compound residue, bridged hydrocarbon compound residue or otherwise those substituted through a carbonyl group such as acyl, carboxy, carbamoyl, alkoxycarbonyl, aryloxycarbonyl, and further those substituted through a hetero atom (specifically those substituted through an oxygen atom such as hydroxy, alkoxy, aryloxy, heterocyclicoxy, siloxy, acyloxy, carbamoyloxy, etc.; those substituted through a nitrogen atom such as nitro, amino (including dialkylamino, etc.), sulfamoylamino, alkoxycarbonylamino, aryloxycarbonylamino, acylamino, sulfonamido, imido, ureido, etc.; those substituted through a sulfur atom such as alkylthio, arylthio, heterocyclic thio, sulfonyl, sulfinyl, sulfamoyl, etc.; those substituted through a phosphorus atom such as phosphonyl, etc.)].

Specific examples include methyl, ethyl, isopropyl, t-butyl, pentadecyl, heptadecyl, 1-hexylnonyl, 1,1'-dipenthylnonyl, 2-chloro-t-butyl, trifluoromethyl, 1-ethoxytridecyl, 1-methoxyisopropyl, methanesulfonylethyl, 2,4-di-t-amylphenoxymethyl, anilino, 1-phenyl-isopropyl, 3-m-butanesulfonaminophenoxypropyl, 3,4'-{α-[4''-(p-hydroxybenzenesulfonyl)phenoxy]-dodecanoylaminophenylpropyl, 3-{4'-[α-2'',4''-di-t-amylphenoxy)butaneamido]phenyl}-propyl, 4-[α-(o-chlorphenoxy)tetradecaneamidophenoxy]propyl, allyl, cyclopentyl and cyclohexyl groups, etc.

The aryl group represented by R is preferably a phenyl group, and it may have substituents (e.g. alkyl group, alkoxy group, acylamino group, etc.).

Specific examples include phenyl, 4-t-butylphenyl, 2,4-di-t-amylphenyl, 4-tetradecaneamidephenyl, hexadecyloxyphenyl, and 4'-[α-(4''-t-butylphenoxy)tetradecaneamido]phenyl groups, etc.

The hetero ring represented by R is preferably 5- to 7-membered ring, and it may be substituted or condensed. Specific examples include 2-furyl, 2-thienyl, 2-pyrimidinyl and 2-benzothiazolyl groups.

Examples of the acyl group represented by R include alkyl carbonyl groups such as acetyl, phenylacetyl, dodecanoyl, α-2,4-di-t-amylphenoxybutanoyl groups; arylcarbonyl groups such as benzoyl, 3-pentadecyloxylbenzoyl, and p-chlorobenzoyl groups.

Examples of the sulfonyl group represented by R include alkylsulfonyl groups such as methylsulfonyl and dodecylsulfonyl groups; arylsulfonyl groups such as benzenesulfonyl and p-toluenesulfonyl groups.

Examples of the sulfinyl group represented by R include alkylsulfinyl groups such as ethylsulfinyl, octylsulfinyl, and 3-phenoxybutylsulfinyl groups; arylsulfinyl groups such as phenylsulfinyl and m-pentadecylphenylsulfinyl groups.

Examples of the phosphonyl group represented by R include alkylphophonyl groups such as butyloctylphosphonyl group; alkoxyphosphonyl groups such as octyloxyphosphonyl group; aryloxyphosphonyl groups such as phenoxyphosphonyl group; arylphosphonyl groups such as phenylphosphonyl group.

The carbamoyl group represented R may be substituted with alkyl groups, aryl groups (preferably phenyl), etc., and its examples include N-methylcarbamoyl, N,N-dibutylcarbamoyl, N-(2-pentadecyloctylethyl)carbamoyl, N-ethyl-N-dodecylcarbamoyl, N-{3-(2,4-di-t-amylphenoxy)propyl}carbamoyl groups.

The sulfamoyl group represented by R may be substituted with alkyl groups, aryl groups (preferably phenyl), etc., and its examples include N-propylsulfamoyl, N,N-diethylsulfamoyl, N-(2-penadecyloxyethyl)-sulfamoyl, N-ethyl-N-dodecylsulfamoyl and N-phenylsulfamoyl groups.

The spiro compound residue represented by R may be, for example, spiro[3,3]heptane-1-yl, etc.

The bridged hydrocarbon compound residue represented by R may be, for example, bicyclo[2,2,1]heptane-1-yl, tricyclo[3,3,1,1,3,7]decane-1-yl-7,7-dimethyl-bicyclo[2,2,1]heptan-1-yl, etc.

The alkoxy group represented by R may be further substituted with the substituents as mentioned above for the alkyl groups, and its examples include methoxy, propoxy, 2-methoxyethoxy, pentadecyloxy, 2-dodecyloxyethoxy and phenethyloxyethoxy groups.

The aryloxy group represented by R is preferably phenyloxy, and the arylnucleus may be further substituted with substituents or atoms on the aryl group as mentioned above, and its examples include phenoxy, p-t-butylphenoxy and m-pentadecylphenoxy groups.

The heterocyclicoxy group represented by R has preferably a 5- to 7-membered hetero ring, said hetero ring may have further substituents, and its examples include 3,4,5,6-tetrahydropyranyl-2-oxy and 1-phenyltetrazol-5-oxy groups.

The siloxy group represented by R may be further substituted with alkyl groups, etc., and its examples include trimethylsiloxy, triethylsiloxy and dimethylbutylsiloxy groups.

The acyloxy group represented by R is, for example, alkylcarbonyloxy and arylcarbonyloxy groups, and it may have further substituents, including specifically acetyloxy, α-chlorocetyloxy and benzoyloxy groups.

The carbamoyloxy group represented by R may be substituted with alkyl groups, aryl groups, etc., and its examples include N-ethylcarbamoyloxy, N,N-diethylcarbamoyloxy and N-phenylcarbamoyloxy groups.

The amino group represented by R may be substituted with alkyl groups, aryl groups (preferably phenyl group), etc., and its examples include ethylamino, anilino, m-chloroanilino, 3-pentadecyloxycarbonylanilino, 2-chloro-5-hexadecaneamidoanilino groups.

The acylamino group represented by R may include alkylcarbonylamino groups, arylcarbonylamino groups, (preferably phenylcarbonylamino group), etc., and it may further have substituents, including specifically acetamide, α-ethylpropaneamide, N-phenylacetamide, dodecaneamide, 2,4-di-t-amylphenoxyacetamide, α-3-t-butyl-4-hydroxyphenoxybutaneamide groups.

The sulfonamide groups represented by R may include alkylsulfonylamino groups, arylsulfonylamino groups, etc., and it may further have substituents. Specific examples include methylsulfonylamino, pentadecylsulfonylamino, benzenesulfonamide, p-toluenesulfonamide, and 2-methoxy-5-t-amylbenzenesulfonamide groups.

The imide group represented by R may be either of a closed chain or cyclic, and it may further have substituents, including, for example, succinimide, 3-heptadecylsuccinimide, phthalimide and gultarimide groups.

The ureido group represented by R may be substituted with alkyl groups, aryl groups (preferably phenyl group), etc., and its examples include N-ethylureido, N-methyl-N-decylureido, N-phenylureido and N-p-tolylureido groups.

The sulfamoylamino group represented by R may be substituted with alkyl groups, aryl groups (preferably phenyl group), etc., and its examples include N,N-dibutylsulfamoylamino, N-methylsulfamoylamino and N-phenylsulfamoylamino groups.

The alkoxycarbonylamino group represented by R may further have substituents, and its examples include methoxycarbonylamino, methoxyethoxycarbonylmino and octadecyloxycarbonylamino groups.

The aryloxycarbonylamino group represented by R may have substituents, and its examples include phenoxycarbonylamino and 4-methylphenoxycarbonylamino groups.

The alkoxycarbonyl group represented by R may have further substituents, and its examples include methoxycarbonyl, butyloxycarbonyl, dodecyloxycarbonyl, octadecyloxycarbonyl, ethoxymethoxycarbonyloxy and benzyloxycarbonyl groups.

The aryloxycarbonyl group represented by R may have further substituents, and its examples include phenoxycarbonyl, p-chlorophenoxycarbonyl and m-pentadecyloxyphenoxycarbonyl groups.

The alkylthio group represented by R may have further substituents, and its examples include ethylthio, dodecylthio, octadecylthio, phenetylthio and 3-phenoxypropylthio groups.

The arylthio group represented by R is preferably phenylthio group, and may further have substituents and its examples include phenylthio, p-methoxyphenylthio, 2-t-octylphenylthio, 3-octadecylphenylthio, 2-carboxyphenylthio and p-acetaminophenylthio groups.

The heterocyclicthio group represented by R is preferably a 5- to 7-membered heterocyclicthio group, and may further have a fused ring or substituents. For example, there may be included 2-pyridylthio, 2-benzothiazorylthio, 2,4-diphenoxy-1,3,5-triazole-6-thio groups.

The substituent eliminable through the reaction with the oxidized product of a color developing agent represented by $X_1$ may include, for example, halogen atoms (chlorine atom, bromine atom, fluorine atom, etc.), or otherwise groups substituted through a carbon atom, an oxygen atom, a sulfur atom or a nitrogen atom.

The group substituted through a carbon atom may include carboxylic group or otherwise the group represented by the formula [IV]:

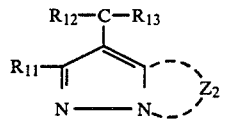

($R_{11}$ has the same meaning as the above R, $Z_2$ has the same meaning as the above $Z_1$, $R_{12}$ and $R_{13}$ represent hydrogen atom, aryl group, alkyl group or heterocyclic group), hydroxymethyl group, triphenylmethyl group, etc.

The group substituted through an oxygen atom includes alkoxy, aryloxy, heterocyclicoxy, acyloxy, sulfonyloxy, alkoxycarbonyloxy, aryloxycarbonyloxy, alkyloxallyloxy and alkoxyoxallyloxy groups.

Said alkoxy group may further have substituents, and its examples include ethoxy, 2-phenoxyethoxy, 2-cyanoethoxy, phenetyloxy and p-chlorobenzyloxy groups.

Said aryloxy group is preferably phenoxy group, and said aryloxy group may further have substituents. Specific examples include phenoxy, 3-methylphenoxy, 3-dodecylphenoxy, 4-methanesulfonamidophenoxy, 4-[α-(3'-pentadecylphenoxy)butaneamide]phenoxy, hexydecylcarbamoylmethoxy, 4-cyanophenoxy, 4-methanesulfonylphenoxy, 1-naphtyloxy, p-methoxyphenoxy groups.

Said heterocyclicoxy group is preferably a 5- to 7-membered heterocyclicoxy group, may be a fused ring or may have substituents. Specific examples include 1-phenyltetrazolyloxy and 2-benzothiazolyloxy groups.

Examples of said acyloxy groups include alkylcarbonyloxy groups such as acetoxy and butanoloxy groups; alkenylcarbonyloxy groups such as cinnamoyloxy group and arylcarbonyloxy group such as benzoyloxy group.

Examples of sulfonyloxy group include butanesulfonyloxy and methanesulfonyloxy groups.

Examples of said alkoxycarbonyloxy include ethoxycarbonyloxy and benzyloxycarbonyloxy groups.

Said aryloxycarbonyloxy group is, for example, phenoxycarbonyloxy group, etc.

Said alkyloxalyloxy group is, for example, methyloxalyloxy group, etc.

Said alkoxyoxalyloxy group is, for example, ethoxyoxalyloxy group, etc.

Examples of the group substituted through a sulfur atom include alkylthio, arylthio, heterocyclicthio and alkyloxythiocarbonylthio groups.

Examples of said alkylthio group include butylthio, 2-cyanoethylthio, phenethylthio and benzylthio groups.

Examples of said arylthio group include phenylthio, 4-methanesulfonamidephenylthio, 4-dodecylphenylthio, 4-nonafluoropentaneamidephenylthio, 4-carboxyphenylthio and 2-ethoxy-5-t-butylphenylthio groups.

Examples of said heterocyclicthio group include 1-phenyl-1,2,3,4-tetrazolyl-5-thio and 2-benzothiazolylthio groups.

Said alkyloxythiocarbonylthio group is, for example, dodecyloxythiocarbonylthio group, etc.

The group substituted through a nitrogen atom may be, for example, those represented by the formula [V]

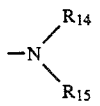

Here, $R_{14}$ and $R_{15}$ represent a hydrogen atom, alkyl, aryl, heterocyclic, sulfamoyl, carbamoyl, acyl, sulfonyl, aryloxycarbonyl or alkoxycarbonyl group, and $R_{14}$ and $R_{15}$ may be bonded together to form a hetero ring. However, $R_{14}$ and $R_{15}$ cannot be hydrogen atoms at the same time.

Said alkyl group may be either straight or branched, having preferably 1 to 22 carbon atoms. The alkyl group may also have substituents, and examples of substituents include aryl, alkoxy, aryloxy, alkylthio, arylthio, alkylamino, arylamino, acylamino, sulfonamide, imino, acyl, alkylsulfonyl, arylsulfonyl, carbamoyl, sulfamoyl, alkoxycarbonyl, aryloxycarbonyl, alkyloxycarbonylamino, aryloxycarbonyl, carboxyl, cyano groups, and halogen atoms.

Specific examples of said alkyl group include ethyl, octyl, 2-ethylhexyl and 2-chloroethyl groups.

The aryl group represented by $R_{14}$ or $R_{15}$ has 6 to 32 carbon atoms, particularly preferably phenyl group or naphthyl group, and said aryl group may have substituents. As the substituent, those as mentioned above for the alkyl group represented by $R_{14}$ or $R_{15}$ and alkyl groups may be employed. Examples of said aryl group include phenyl, 1-naphthyl and 4-methylsulfonylphenyl groups.

The heterocyclic group represented by $R_{14}$ or $R_{15}$ is preferably a 5- to 6-membered ring, may be a fused ring or may also have substituents. Specific examples include 2-furyl, 2-quinolyl, 2-pyrimidyl, 2-benzothiazolyl and 2-pyridyl groups.

The sulfamoyl group represented by $R_{14}$ or $R_{15}$ may include N-alkylsulfamoyl, N,N-dialkylsulfamoyl, N-arylsulfamoyl and N,N-diarylsulfamoyl groups, and these alkyl and aryl groups may have the substituents as mentioned above for the alkyl and aryl groups. Specific examples of the sulfamoyl group include N,N-diethylsulfamoyl, N-methylsulfamoyl, N-dodecylsulfamoyl and N-p-tolylsulfamoyl groups.

The carbamoyl group represented by $R_{14}$ or $R_{15}$ may include N-alkylcarbamoyl, N,N-dialkylcarbamoyl, N-arylcarbamoyl and N,N-diarylcarbamoyl groups, and these alkyl and aryl groups may have the substituents as mentioned above for the alkyl and aryl groups. Specific examples of the carbamoyl group include N,N-diethylcarbamoyl, N-methylcarbamoyl, N-dodecylcarbamoyl, N-p-cyanophenylcarbamoyl and N-p-tolylcarbamoyl groups.

The acyl group represented by $R_{14}$ or $R_{15}$ may be, for example, alkylcarbonyl, arylcarbonyl and heterocyclic-carbonyl groups, and said alkyl, aryl and heterocyclic groups may also have substituents. Specific examples of the acyl group include hexafluorobutanoyl, 2,3,4,5,6-pentafluorobenzoyl, acetyl, benzoyl, naphthoyl, and 2-furylcarbonyl groups.

The sulfonyl group represented by $R_{14}$ or $R_{15}$ may include alkylsulfonyl, arylsulfonyl and heterocyclic sulfonyl groups, which may further have substituents. Specific examples include ethanesulfonyl, benzenesulfonyl, octanesulfonyl, naphthalenesulfonyl and p-chlorobenzenesulfonyl groups.

The aryloxy carbonyl group represented by $R_{14}$ or $R_{15}$ may have the substituents as mentioned above for the aryl group, typically phenoxy carbonyl group, etc.

The alkoxy carbonyl group represented by $R_{14}$ or $R_{15}$ may have the substituents as mentioned above for the alkyl group, and its specific examples include methoxycarbonyl, dodecyloxycarbonyl and benzyloxycarbonyl groups.

The hetero ring formed by bonding of $R_{14}$ and $R_{15}$ is preferably a 5- to 6-membered ring, and it may be either saturated or unsaturated or may also have aromaticity or not. Also, it may be a fused ring. Examples of said hetero ring include N-phthalimide, N-succinimide, 4-N-urazolyl, 1-N-hydanthoinyl, 3-N-2,4-dioxosazolidinyl, 2-N-1,1-dioxo-3-(2H)-oxo-1,2-benzthiazolyl, 1-pyrrolyl, 1-pyrroridinyl, 1-pyrazolyl, 1-pyrazolidinyl, 1-piperidinyl, 1-pyrrolynyl, 1-imidazolyl, 1-imidazolinyl, 1-indolyl, 1-isoindolinyl, 2-isoindolyl, 2-isoindolinyl, 1-benzotriazolyl, 1-benzoimidazolyl, 1-(1,2,4-triazolyl), 1-(1,2,3-triazolyl), 1-(1,2,3,4-terorazolyl), N-morpholinyl, 1,2,3,4-tetrahydroquinolyl, 2-oxo-1-pyrrolidinyl, 2-1H-pyridone, phthaladione, 2-oxo-1-piperidinyl groups. These heterocyclic groups may be substituted with alkyl, aryl, alkyloxy, aryloxy, acyl, sulhyphonyl, alkylamino, arylamino, acylamino, sulfonamino, carbamoyl, sulfamoyl, alkylthio, arylthio, ureido, alkoxycarbonyl, aryloxycarbonyl, imido, nitro, cyano, carboxyl groups and halogen atoms, etc.

The nitrogen-containing heterocyclic ring formed by $Z_1$ or $Z_2$ may include pyrazole ring, imidazole ring, triazole ring or tetrazole ring, and the substituents which may be possessed by the above rings include those as mentioned above for R.

When the substituent (e.g. R'', $R_{21}$–$R_{26}$) on the heterocyclic ring in the formula [III] and the formulae [IV]–[XII] has a moiety represented by the following formula:

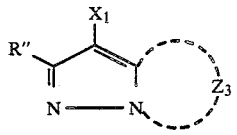

(wherein R'', $X_1$ and $Z_3$ have the same meanings as R, $X_1$, $Z_1$ in the formula [I], respectively), the so called bis-type coupler is formed and this type is of course included in this invention. Also, the ring formed by $Z_1$, $Z_2$, $Z_3$ and $Z_4$ as hereinafter described may be further condensed with another ring (e.g. 5- to 7-membered cycloalkene). For example, in the formula [IX], $R_{25}$ and $R_{26}$, while in the formula [X], $R_{27}$ and $R_{28}$ may be bonded together to form a ring (e.g. 5- to 7-membered cycloalkene, benzene).

The magenta coupler of this invention represented by the formula [I] are represented more specifically by, for example, the formulae [VI]–[XII] shown below.

Formula [VI]

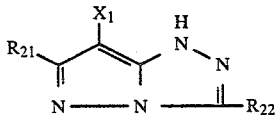

-continued

Formula [VII]

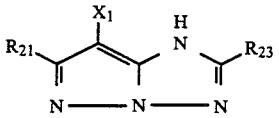

Formula [VIII]

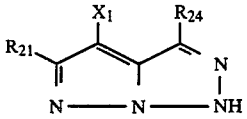

Formula [IX]

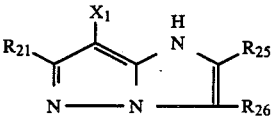

Formula [X]

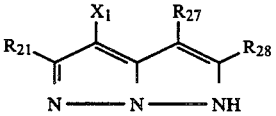

Formula [XI]

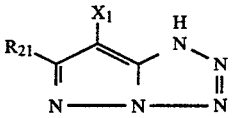

In the above formulae [VI]-[XI], $R_{21}$ to $R_{28}$ and $X_1$ have the same meanings as the above R and $X_1$, respectively, and $R_{21}$ to $R_{28}$ or $X_1$ are may also form a polymer of dimer or higher.

Preferable magenta couplers of this invention are represented by the following formula [XII]

Formula [XII]

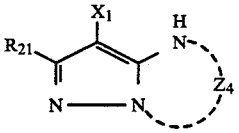

wherein $R_{21}$, $X_1$ and $Z_4$ have the sae meanings as R, $X_1$ and $Z_1$ in the formula [I], respectively.

Of the magenta couplers represented by the above formulae [VI] to [XII], particularly preferred are magenta couplers represented by the formula [VI].

As for the substituents on the heterocyclic ring in the formulae [I] and [VI] to [XII], it is preferable that R in the formula [I] and $R_{21}$ in the formulae [VI] to [XII] should satisfy the following condition 1, more preferably both of the following conditions 1 and 2.

Condition 1: the root atom directly bonded to the heterocyclic ring is a carbon atom;

Condition 2: at least 2 hydrogen atoms are bonded to said carbon atom.

Of the substituents R and $R_{21}$ on the above heterocyclic ring, most preferred are those represented by the following formula [XIIA]:

$$R_{29}—CH_2—. \qquad \text{Formula [XIIA]}$$

In the above formula, $R_{29}$ represents a hydrogen atom, a halogen atom, alkyl, cycloalkyl, alkenyl, cycloalkenyl, alkynyl, aryl, heterocyclic, acyl, sulfonyl, sulfinyl, phosphonyl, carbamoyl, sulfamoyl, cyano, spiro compound residue, organic hydrocarbon compound residue, alkoxy, aryloxy, heterocyclicoxy, siloxy, acyloxy, carbamoyloxy, amino, acylamino, sulfoneamido, imido, ureido, sulfamoylamino, alkoxycarbonylamino, aryloxycarbonylamino, aryloxycarbonyl, alkylthio, arylthio, heterocyclicthio groups.

The group represented by $R_{29}$ may also have substituents, and specific examples of the group represented by $R_{29}$ and the substituents which may be possessed by said group include the specific examples and substituents as described above for the group R in the above formula [I].

Hydrogen atom or an alkyl group is preferred as $R_{29}$.

Specific examples of the magenta coupler of this invention are enumerated below, but this invention is not limited to these.

[M-1]

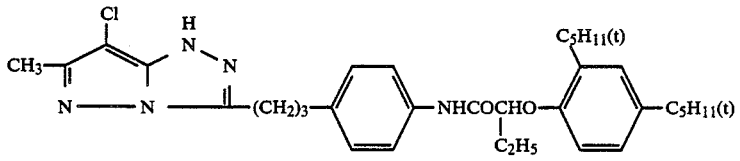

[M-2]

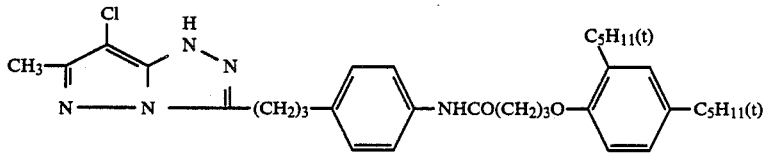

[M-3]

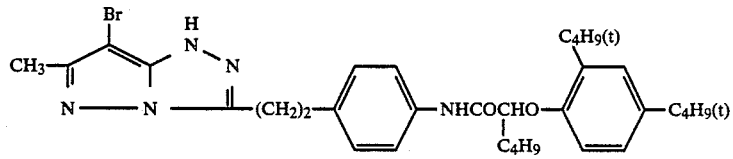

-continued
[M-4]
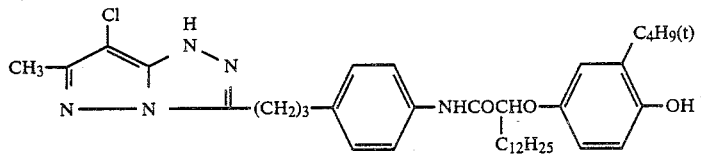
[M-5]
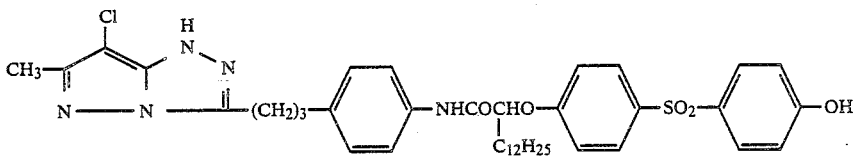
[M-6]
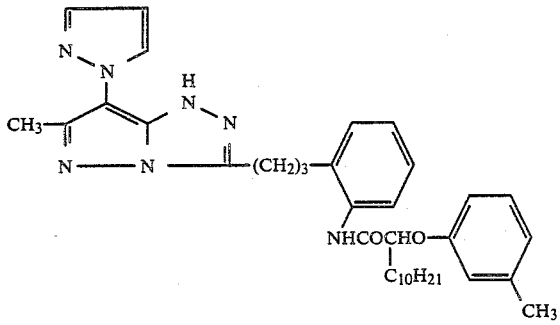
[M-7]
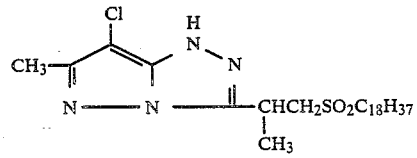
[M-8]
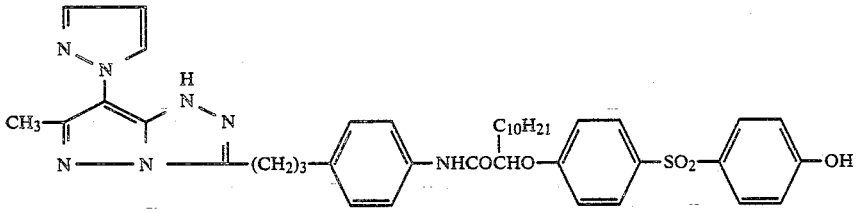
[M-9]
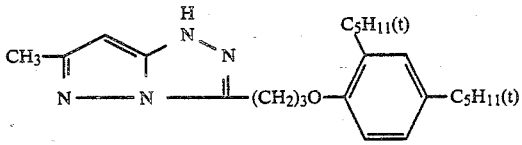
[M-10]
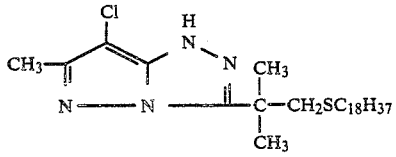
[M-11]
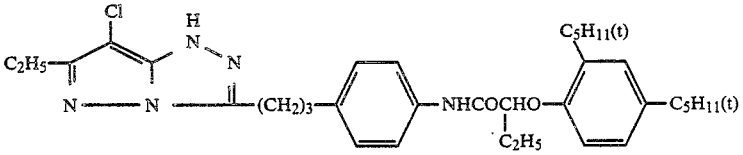

-continued
[M-12]
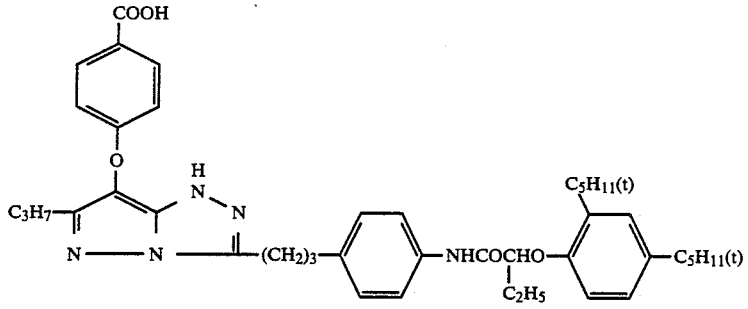
[M-13]
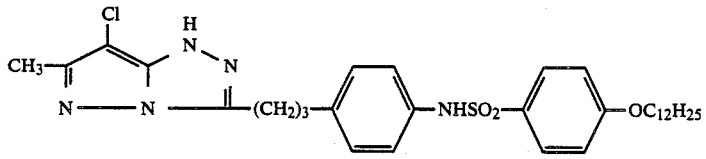
[M-14]
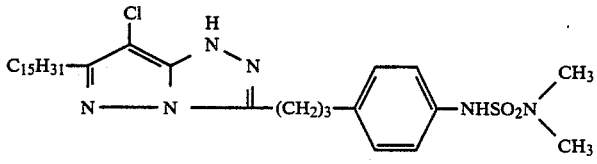
[M-15]
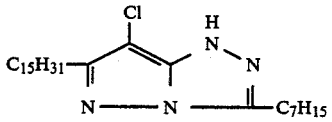
[M-16]
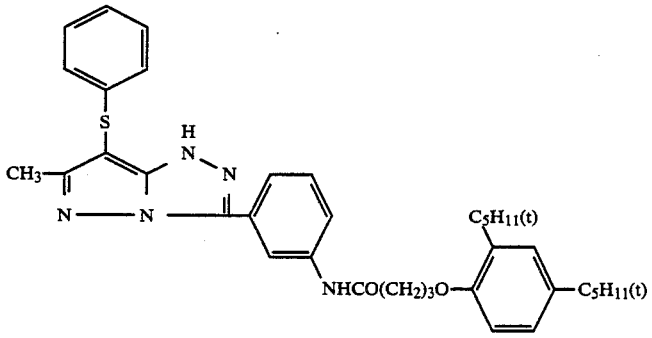
[M-17]
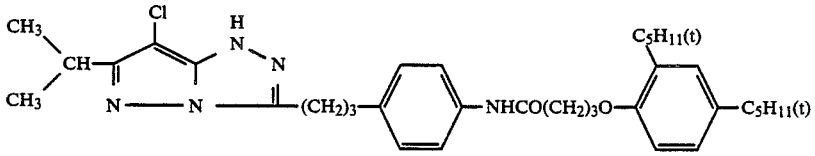
[M-18]
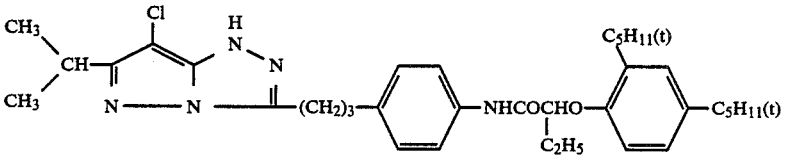
[M-19]
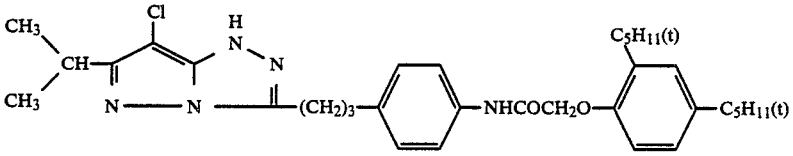

-continued
[M-20]
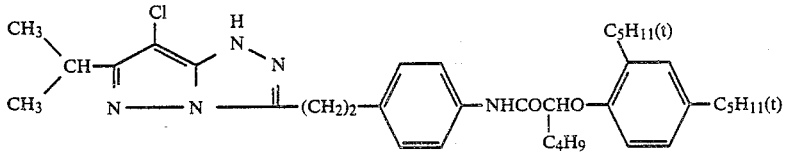
[M-21]
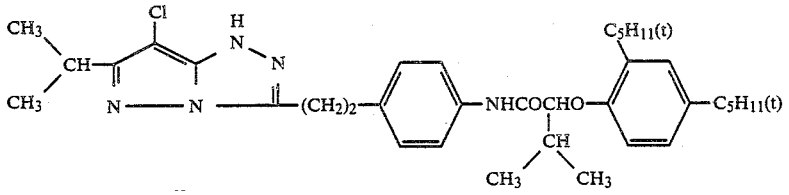
[M-22]
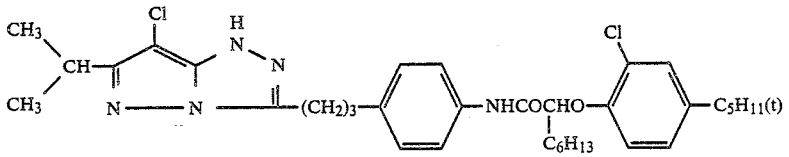
[M-23]
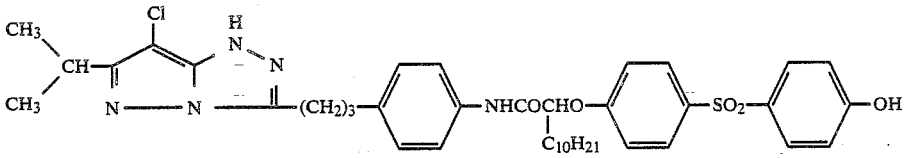
[M-24]
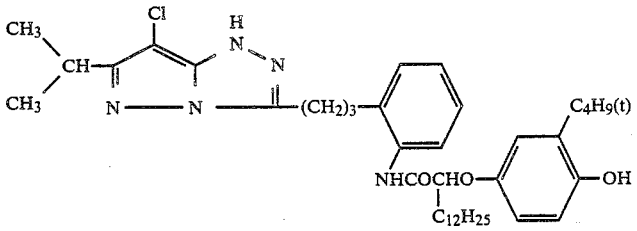
[M-25]
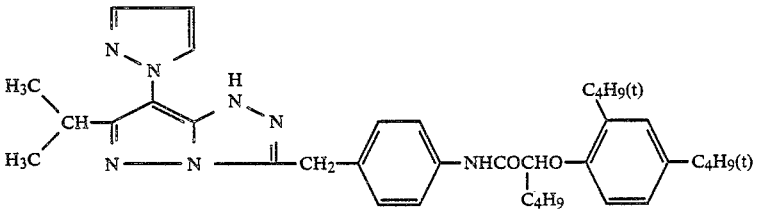
[M-26]
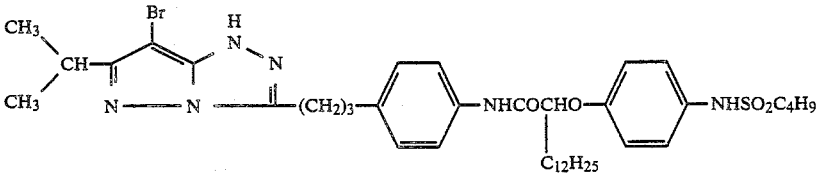
[M-27]
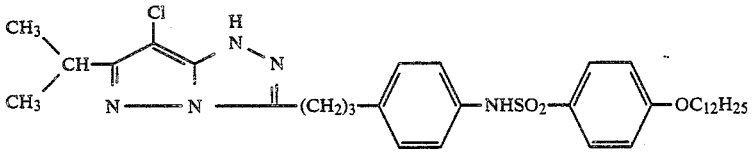

-continued
[M-28]
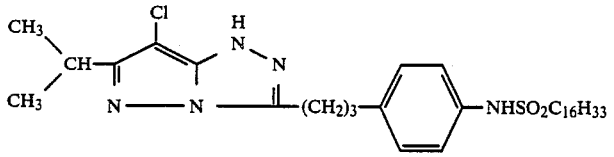
[M-29]
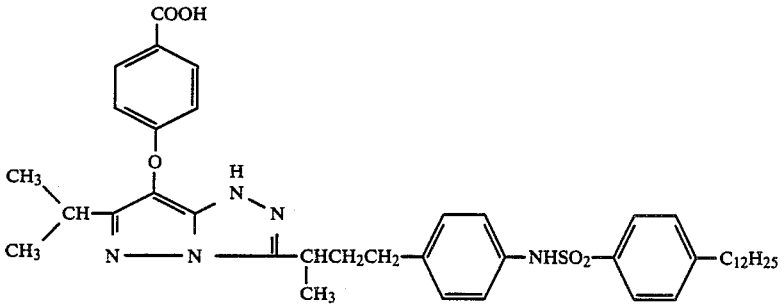
[M-30]
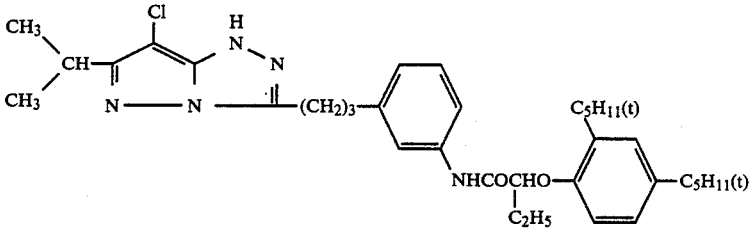
[M-31]
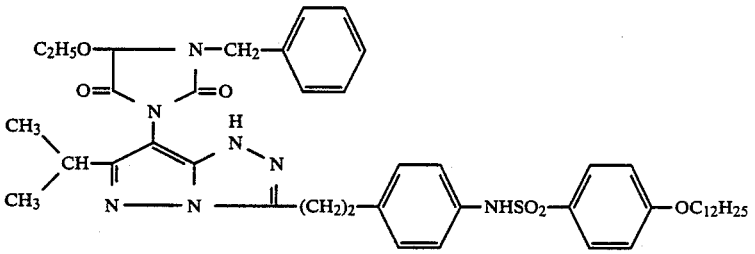
[M-32]
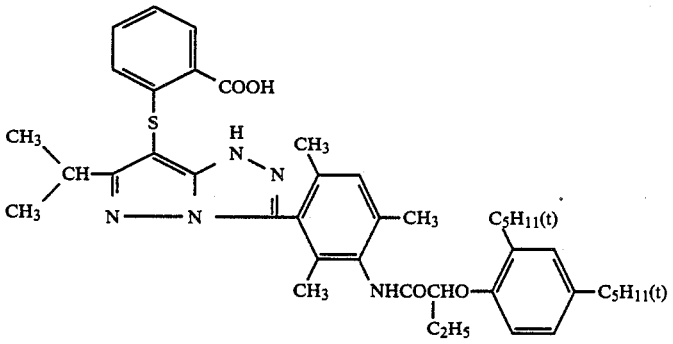
[M-33]
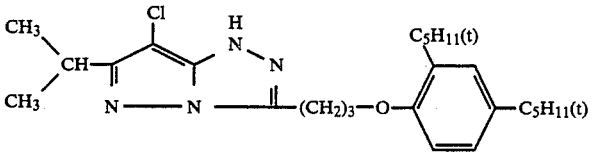

-continued
[M-34]
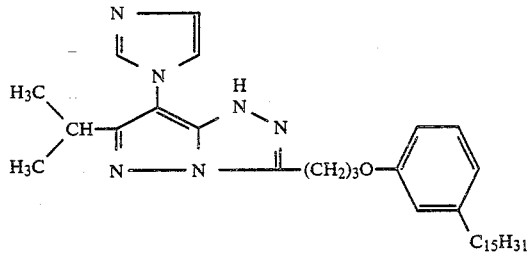
[M-35]
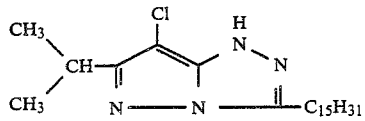
[M-36]
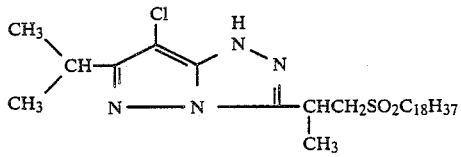
[M-37]
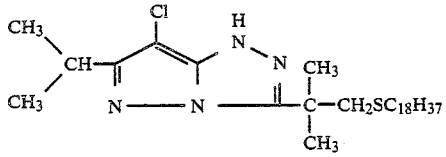
[M-38]
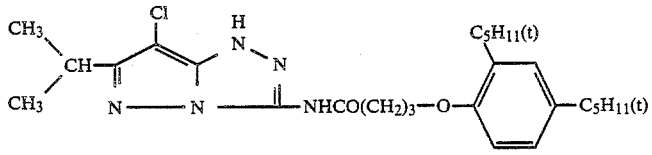
[M-39]
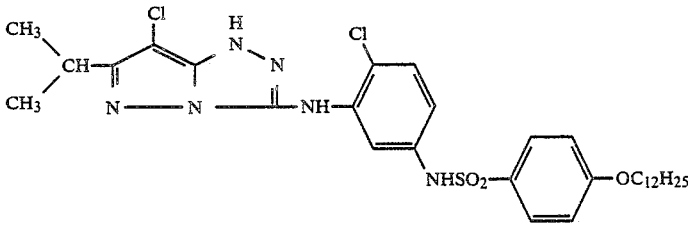
[M-40]
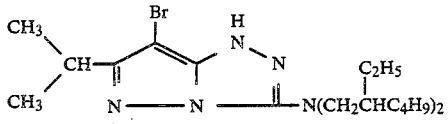
[M-41]
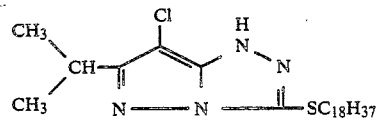
[M-42]
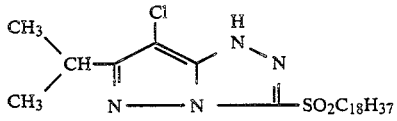

-continued
[M-43]
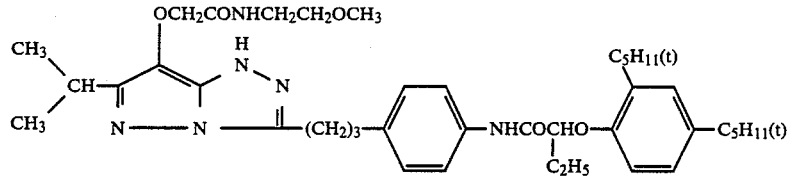
[M-44]
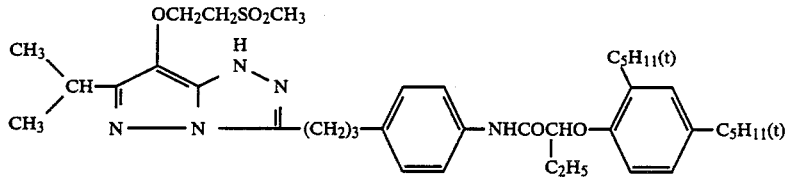
[M-45]
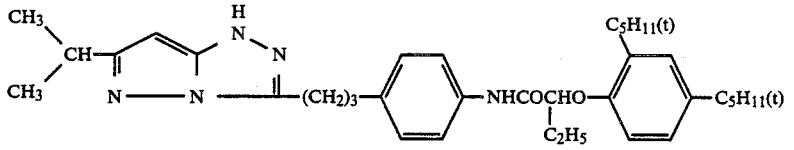
[M-46]
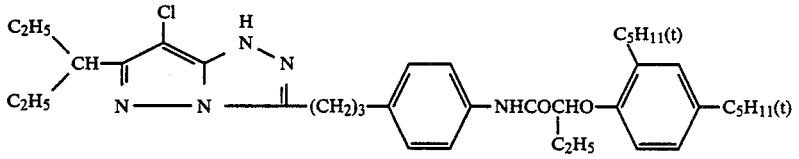
[M-47]
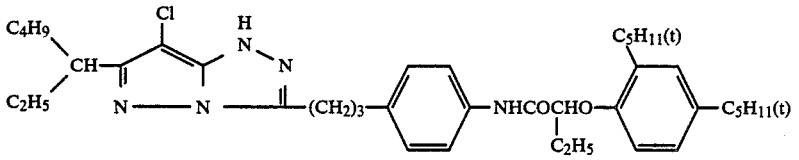
[M-48]
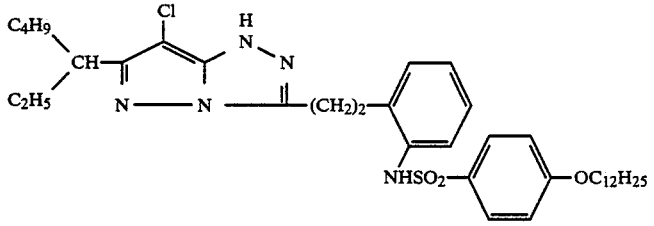
[M-49]
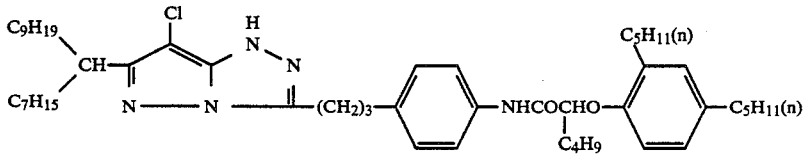
[M-50]
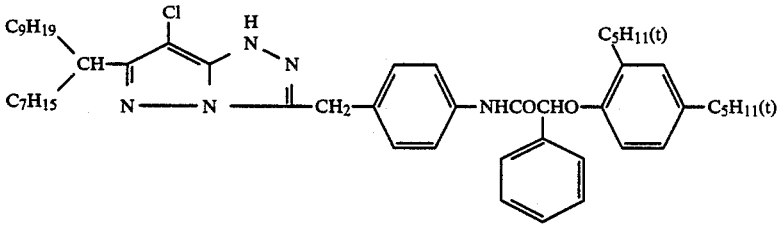
[M-51]
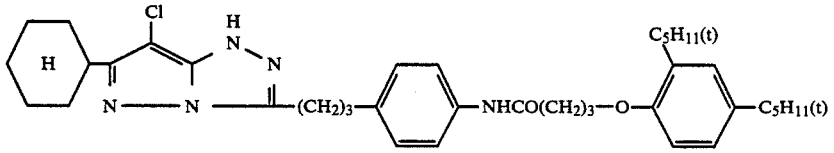

-continued
[M-52]
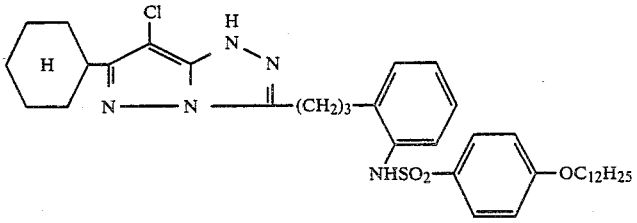
[M-53]
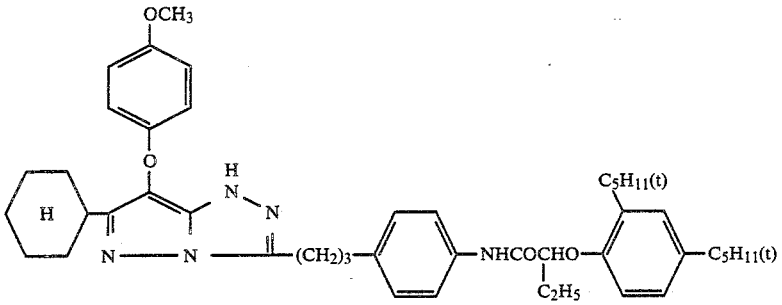
[M-54]
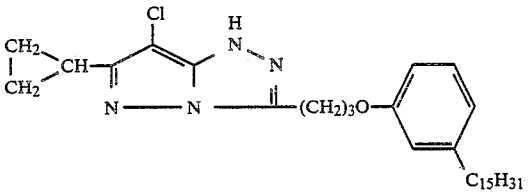
[M-55]
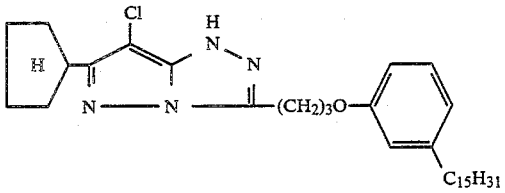
[M-56]
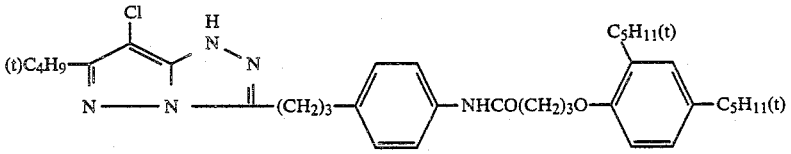
[M-57]
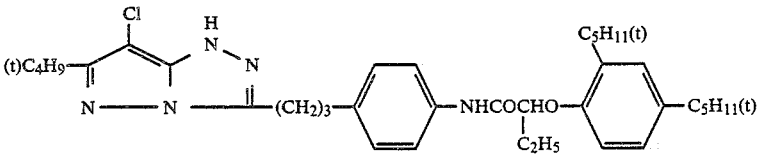
[M-58]
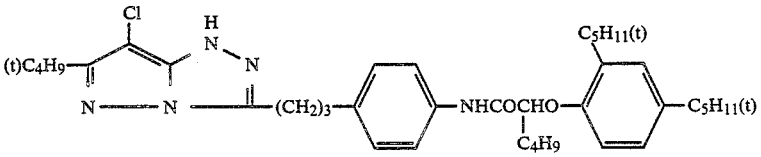
[M-59]
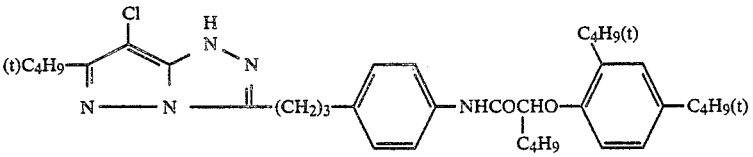

-continued
[M-60]
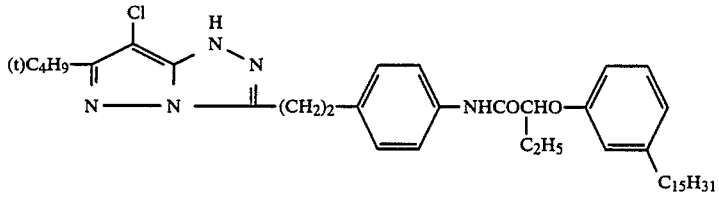
[M-61]
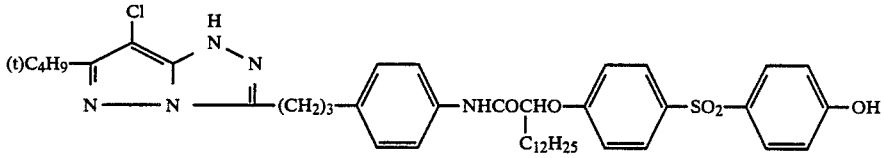
[M-62]
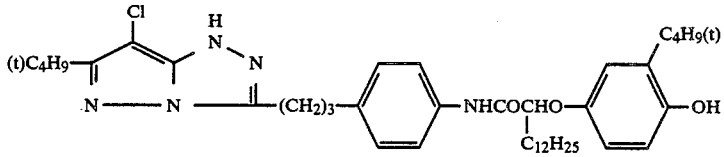
[M-63]
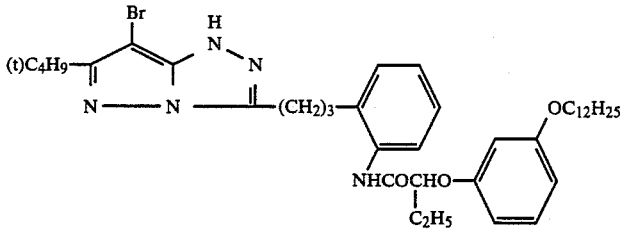
[M-64]
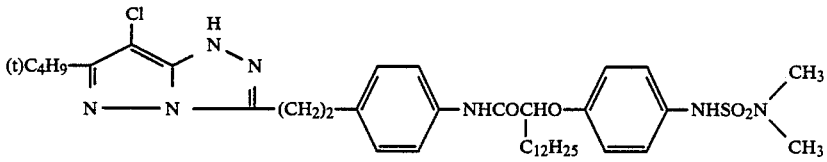
[M-65]
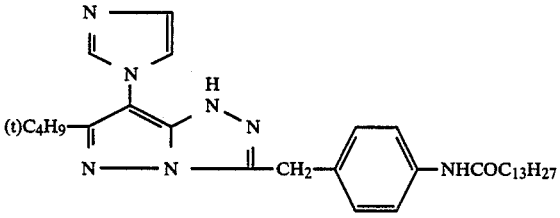
[M-66]
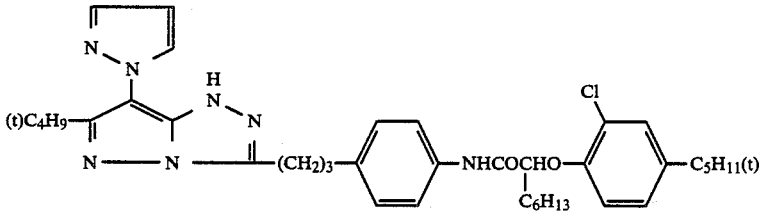
[M-67]
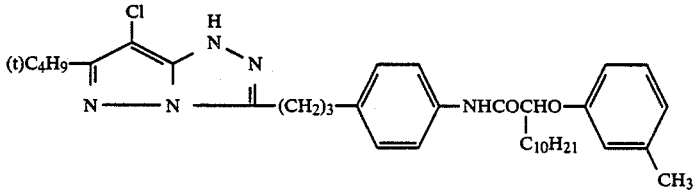

-continued
[M-68]
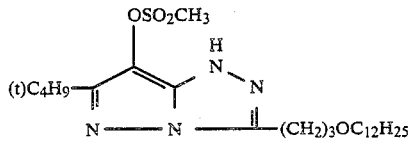
[M-69]
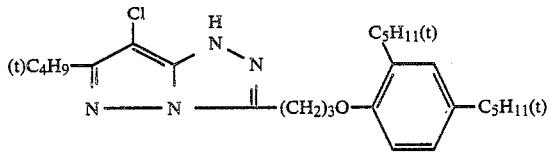
[M-70]
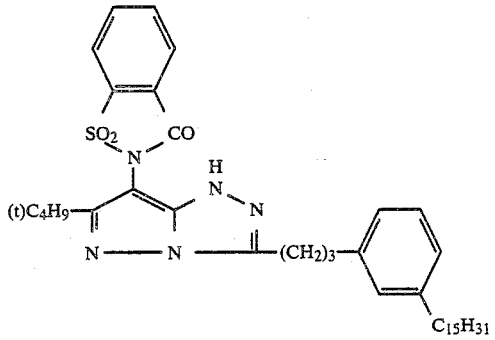
[M-71]
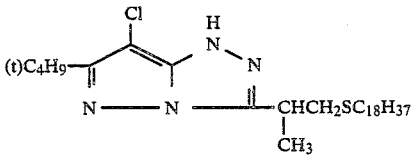
[M-72]
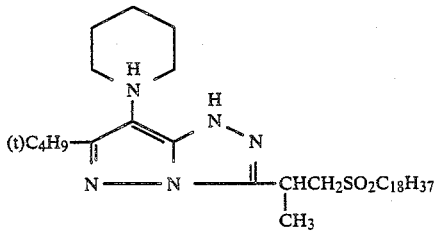
[M-73]
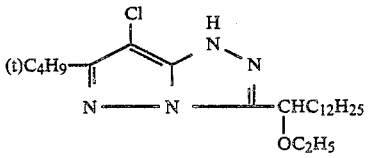
[M-74]
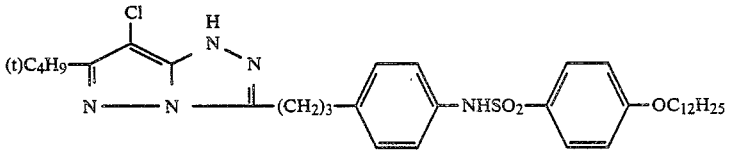

-continued
[M-75]
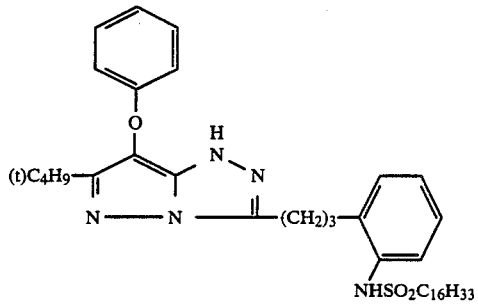
[M-76]
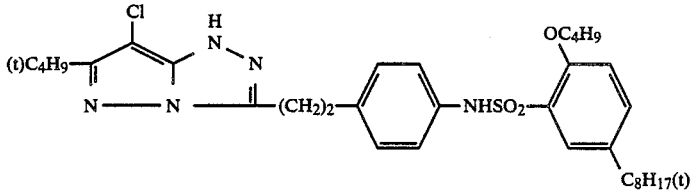
[M-77]
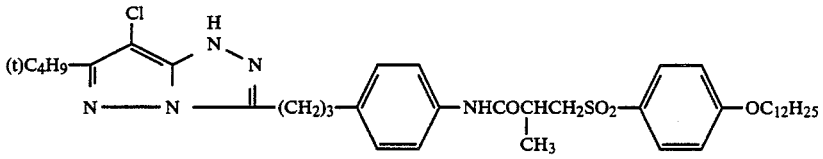
[M-78]
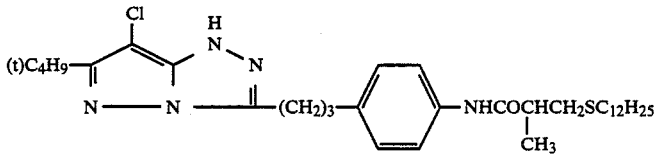
[M-79]
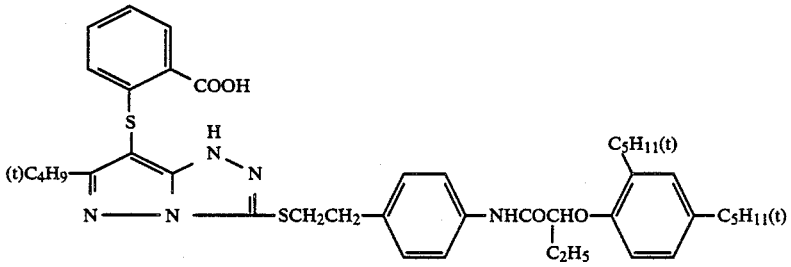
[M-80]
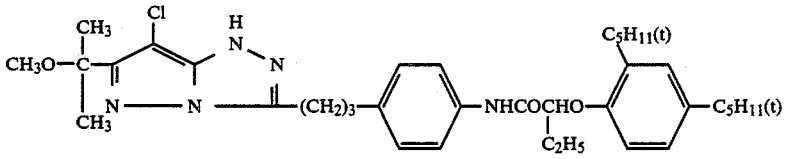
[M-81]
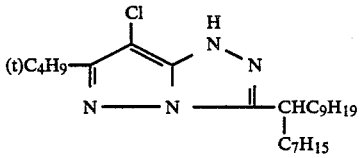

-continued
[M-82]
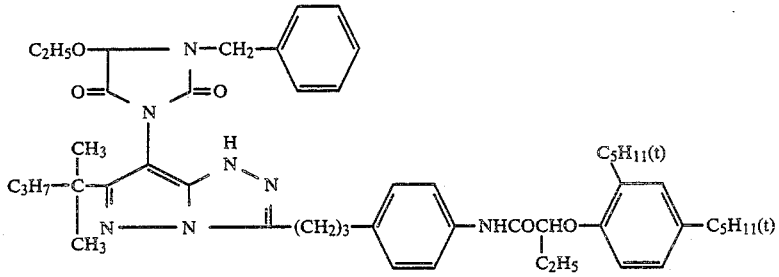
[M-83]
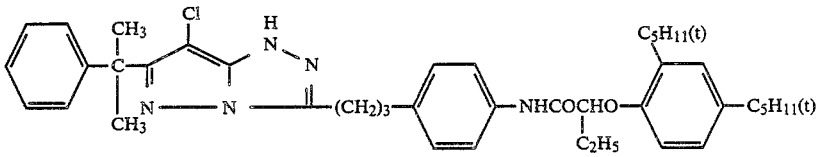
[M-84]
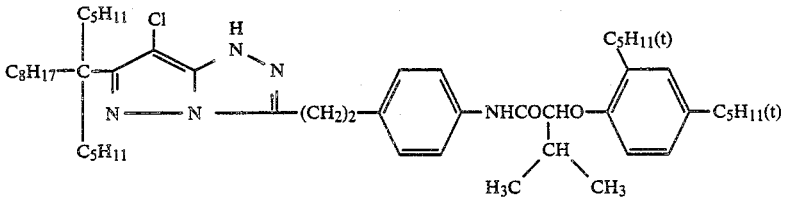
[M-85]
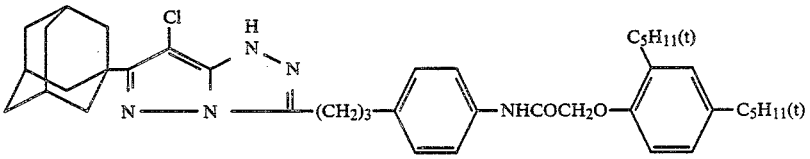
[M-86]
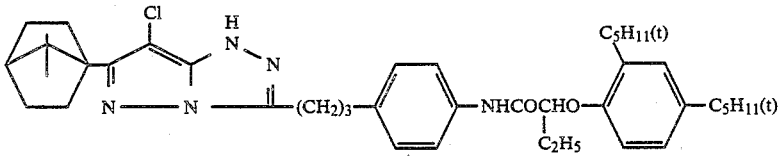
[M-87]
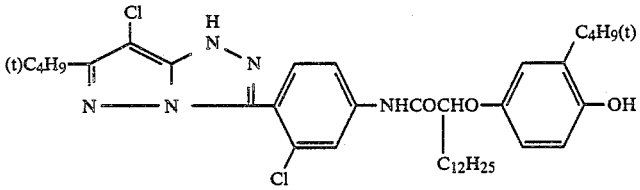
[M-88]
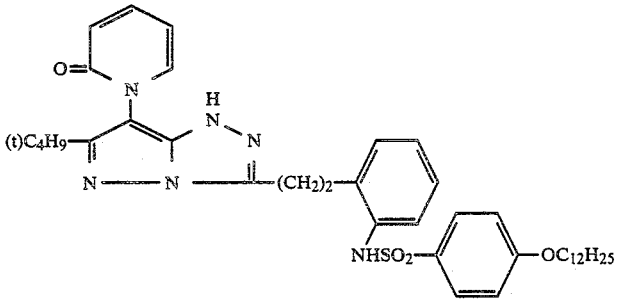

-continued
[M-89]
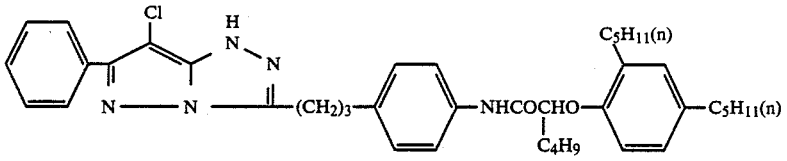
[M-90]
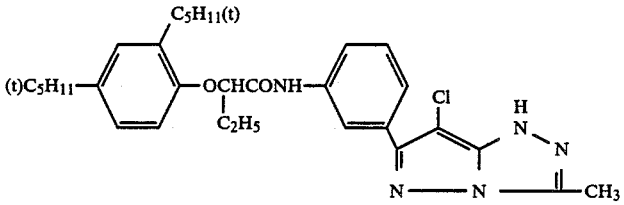
[M-91]
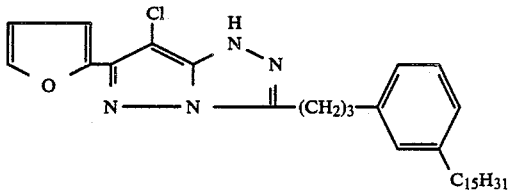
[M-92]
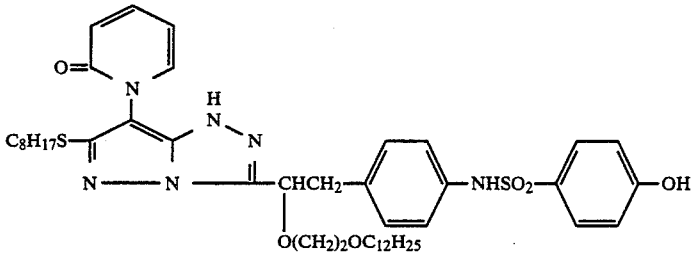
[M-93]
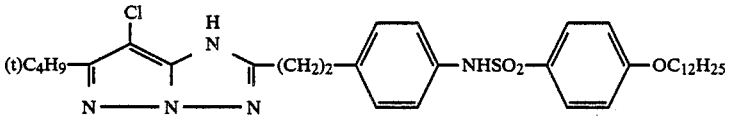
[M-94]
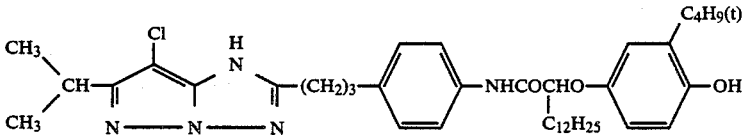
[M-95]
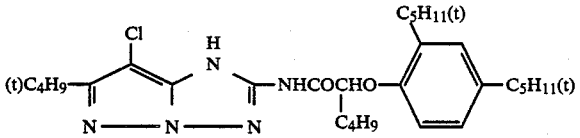
[M-96]
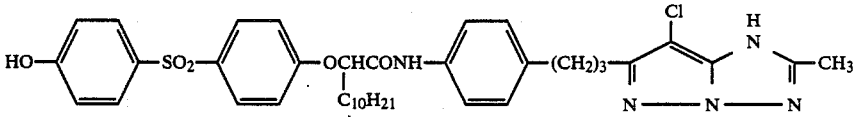
[M-97]
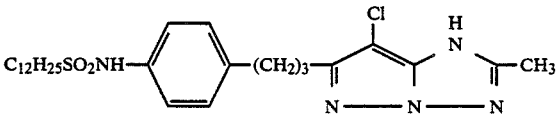

-continued
[M-98]
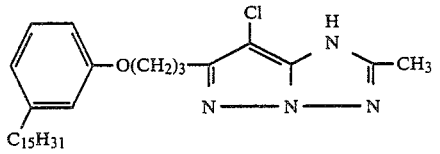
[M-99]
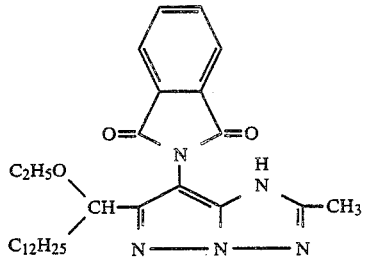
[M-100]
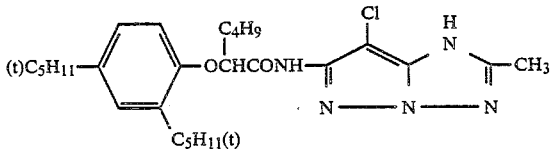
[M-101]
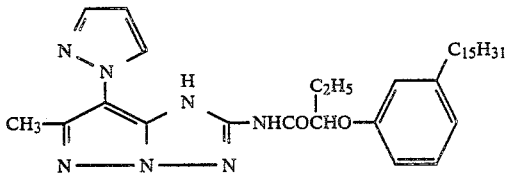
[M-102]
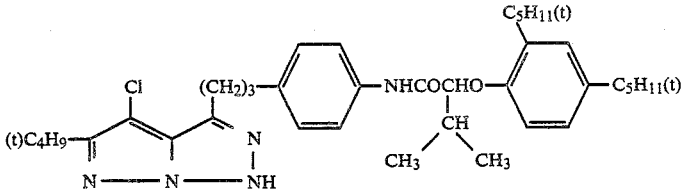
[M-103]
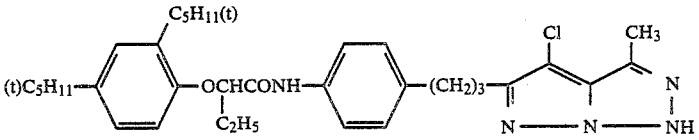
[M-104]
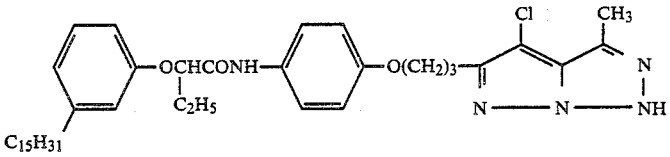
[M-105]
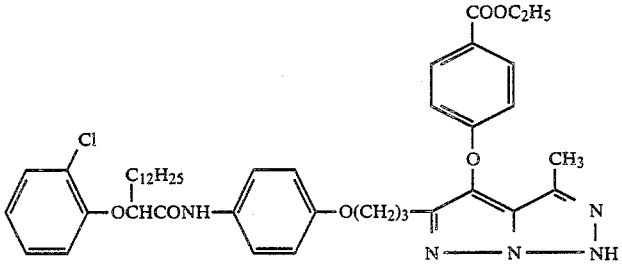

-continued
[M-106]
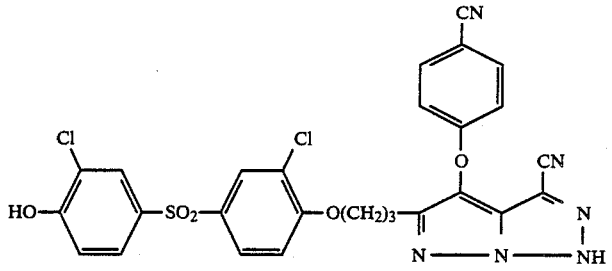
[M-107]
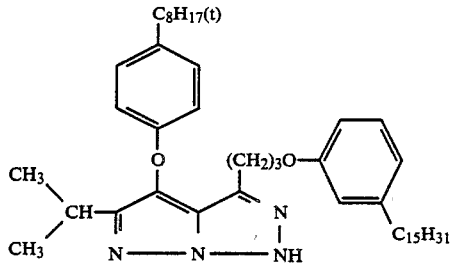
[M-108]
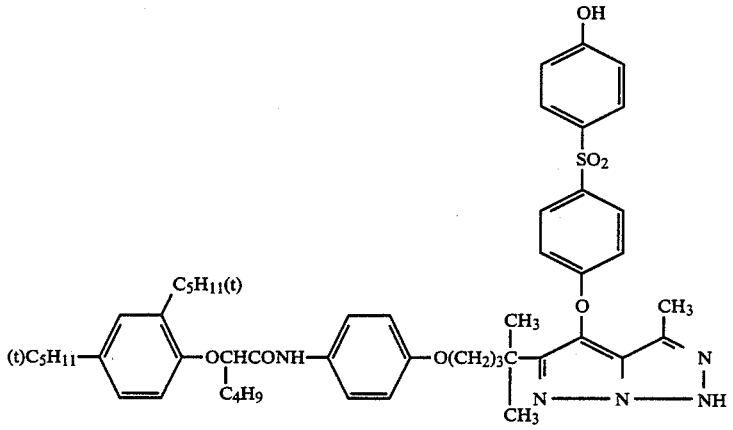
[M-109]
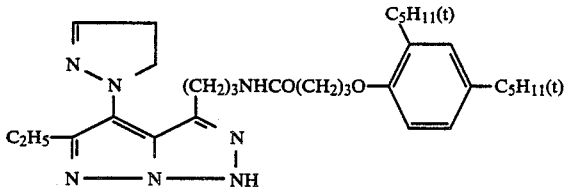
[M-110]
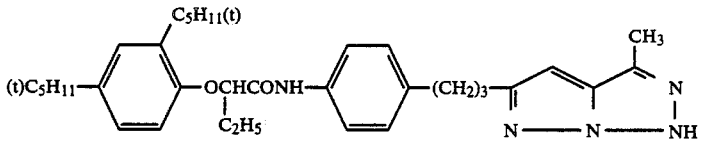
]M-111]
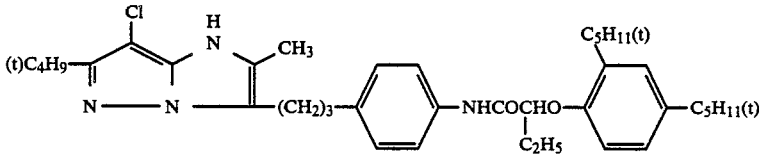
[M-112]
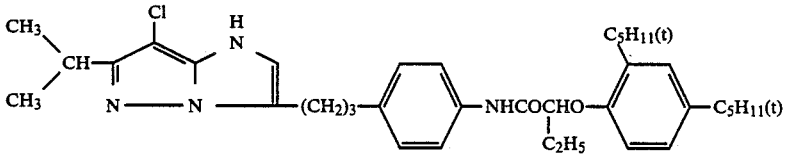

-continued
[M-113]
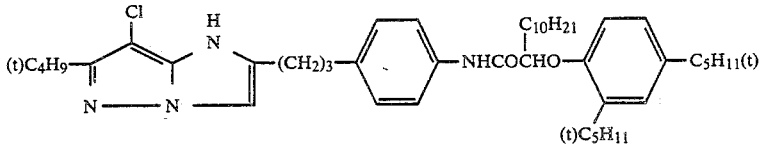
[M-114]
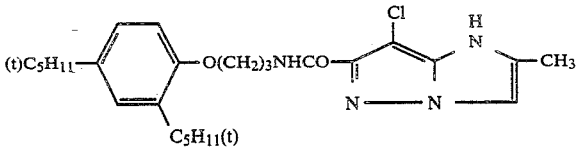
[M-115]
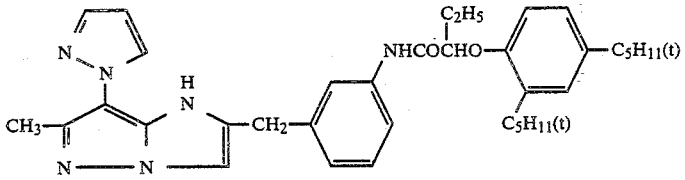
[M-116]
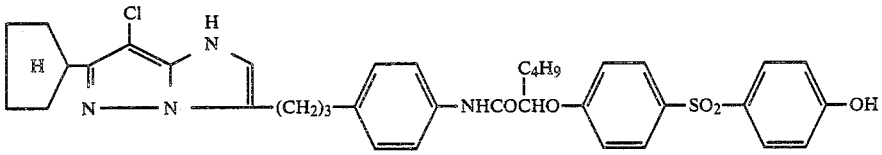
[M-117]
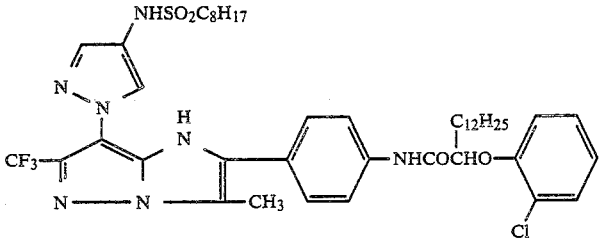
[M-118]
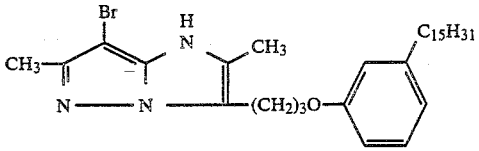
[M-119]
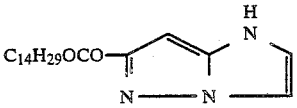
[M-120]
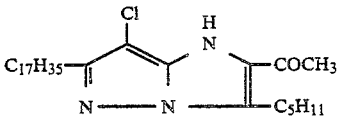
[M-121]
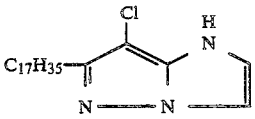
[M-122]
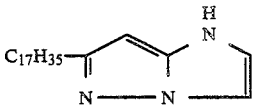

-continued
[M-123]
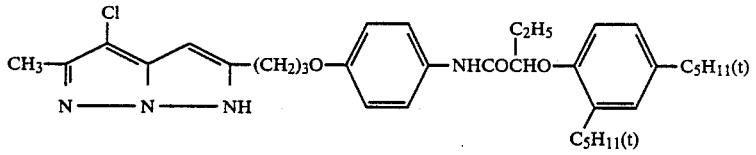
[M-124]
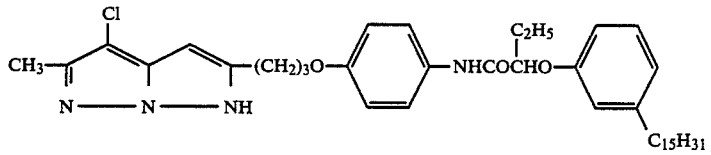
[M-125]
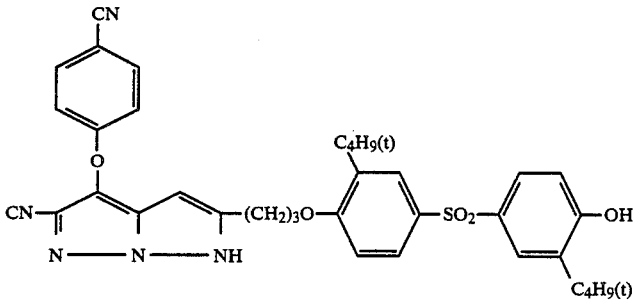
[M-126]
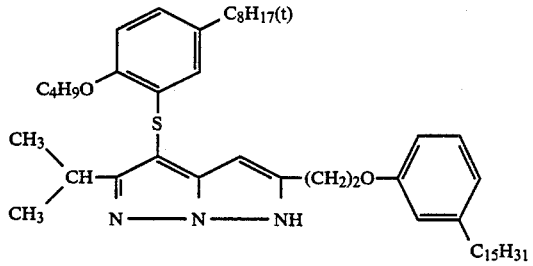
[M-127]
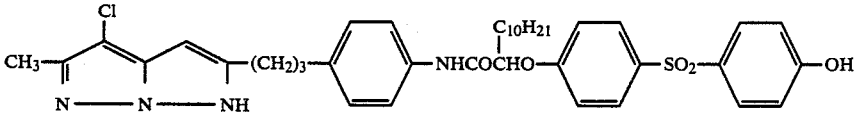
[M-128]
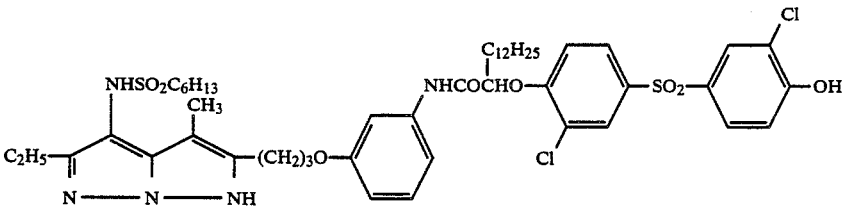
[M-129]
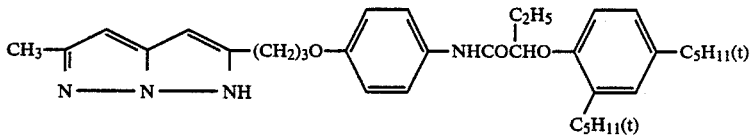
[M-130]
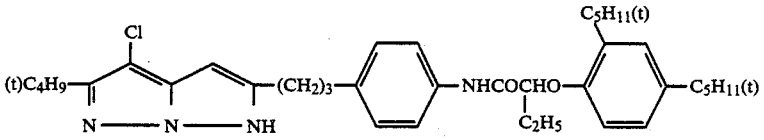

-continued
[M-131]
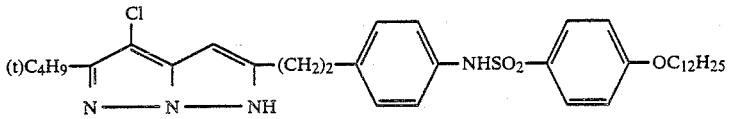
[M-132]
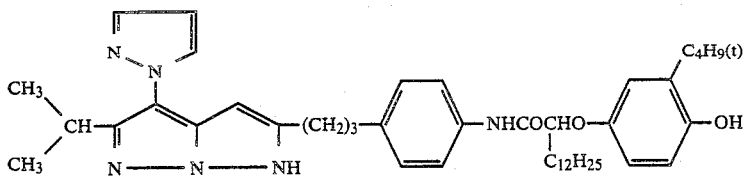
[M-133]
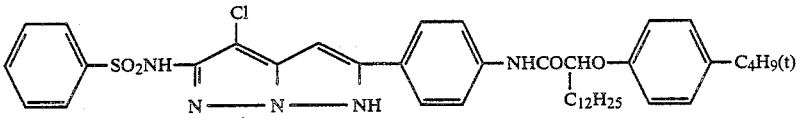
[M-134]
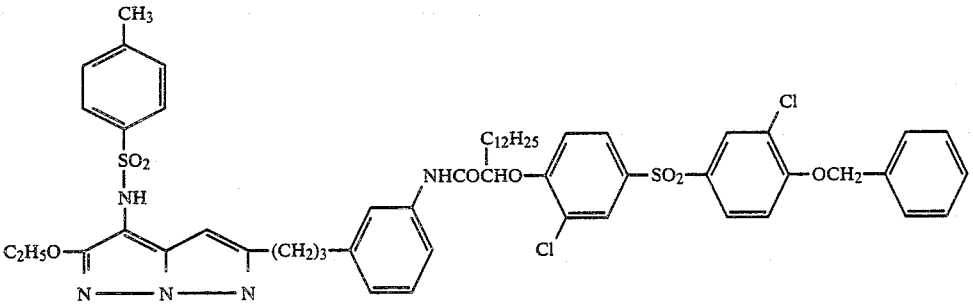
[M-135]
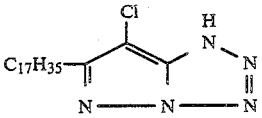
[M-136]
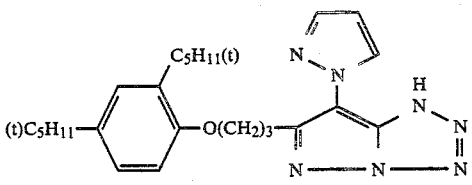
[M-137]
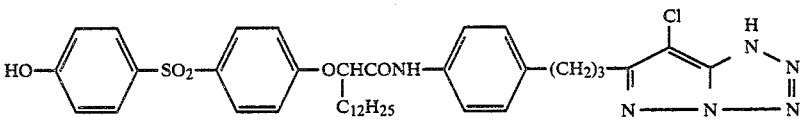
[M-138]
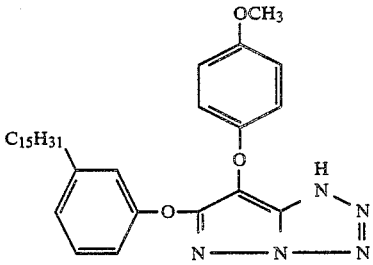

-continued

[M-139]

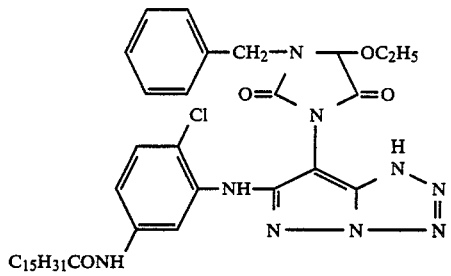

[M-140]

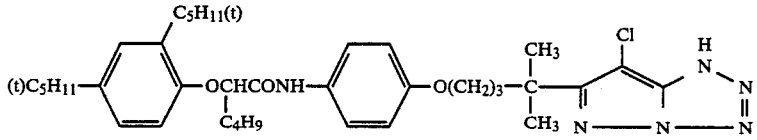

[M-141]

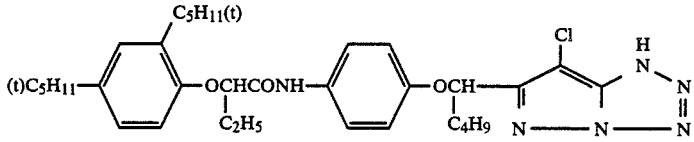

[M-142]

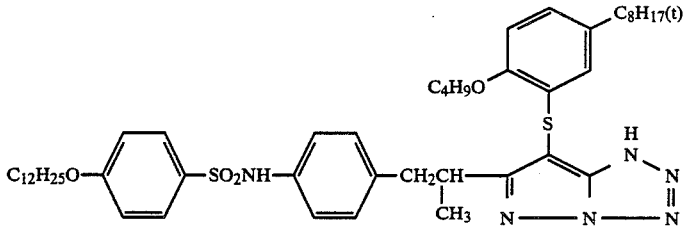

[M-143]

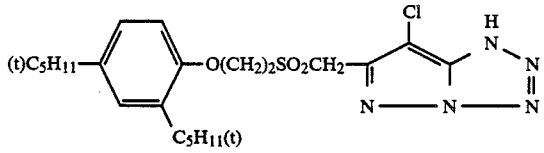

These magenta couplers can be synthesized with reference to Journal of the Chemical Society, Perkin I (1977), 2047-2052, U.S. Pat. No. 3,725,067, Japanese Unexamined Patent Publications Nos. 9437/1984 and 42045/1983.

The magenta coupler of this invention can be used in an amount generally in the range from $1\times10^{-3}$ mol to 1 mol, preferably from $1\times10^{-2}$ mol to $8\times10^{-1}$, per mol of silver halide contained in the green-sensitive layers.

The magenta coupler of this invention can be also used in combination with other kinds of magenta couplers.

Next, as the ureido type coupler of this invention, it is possible to use phenol type cyan couplers having at the 2-position a group selected from phenylureido group, naphthylureido group and heterocyclicureido groups and at the 5-position an acylamino group, and it is preferable in this invention to use these cyan couplers (hereinafter this is called the ureido type cyan coupler according to this invention). The ureido type cyan coupler according to this invention is represented by the following formula [XIII a] or [XIII b], preferably the formula [XIII a].

Formula [XIII a]

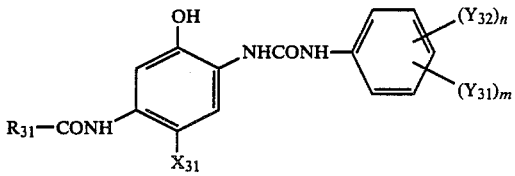

Formula [XIII b]

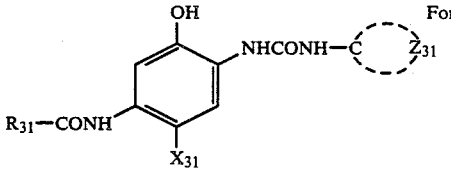

In the above formulae, $Y_{31}$ represents trifluoromethyl, nitro, halogen atom (e.g. fluorine, chlorine, bromine, etc.), cyano or a group represented by $-COR_{30}$, $-COOR_{30}$, $-SO_2R_{30}$, $-SO_2OR_{30}$,

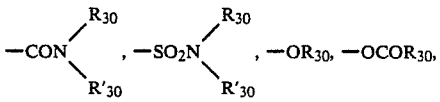

-continued

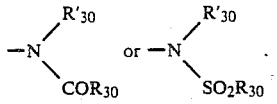

$R_{30}$ represents an aliphatic group [preferably an alkyl group having 1 to 10 carbon atoms (e.g. methyl, butyl, cyclohexyl, benzyl)] or an aromatic group [preferably a phenyl group (e.g. phenyl, tolyl)], and $R'_{30}$ represents a hydrogen atom or a group represented by $R_{30}$.

$Y_{32}$ represents a monovalent group, preferably an aliphatic group [preferably a straight or branched alkyl group having 1 to 10 carbon atoms (e.g. methyl, t-butyl, ethoxyethyl, cyanomethyl)], an aromatic group [preferably a phenyl group, naphthyl group (e.g. phenyl, tolyl)], a halogen atom (e.g. fluorine, chlorine, bromine atom, etc.), an alkylamino group (e.g. ethylamino, diethylamino), a hydroxy group, a cyano group or a substituent represented by $Y_1$.

m represents an integer from 1 to 3, and n an integer from 0 to 3, with proviso $m+n \leqq 5$.

$Z_{31}$ represents a group of non-metal atoms necessary for formation of a heterocyclic group or a naphthyl group, and the heterocyclic group may preferably a 5-membered or 6-membered hetero ring containing 1 to 4 nitrogen atoms, oxygen atoms or sulfur atoms. For example, there may be included furyl, thienyl, pyridyl, quinolyl, oxazolyl, tetrazolyl, benzothiazolyl, and tetrahydrofuranyl groups.

These rings can have substituents. Examples of substients include straight or branched alkyl groups having 1 to 10 carbon atoms (e.g. ethyl, i-propyl, i-butyl, t-butyl, t-octyl, etc.), aryl groups (e.g. phenyl, naphthyl), halogen atoms (fluorine, chlorine, bromine atoms, etc.), cyano, nitro, sulfonamide groups (e.g. methanesulfonamide, butanesulfonamide, p-toluenesulfonamide, etc.), sulfamoyl groups (e.g. methylsulfamoyl, phenylsulfamoyl, etc.), sulfonyl groups (e.g. methanesulfonyl, p-toluenesulfonyl, etc.), fluorosulfonyl, carbamoyl groups (e.g. dimethylcarbamoyl, phenylcarbamoyl, etc.), oxycarbonyl group (e.g. ethoxycarbonyl, phenoxycarbonyl, etc.), acyl group (e.g. acetyl, benzoyl, etc.), heterocyclic group (e.g. pyridyl group, pyrazolyl group, etc.), alkoxy, aryloxy and acyloxy groups.

$R_{31}$ represents a ballast group necessary for imparting diffusion resistance to the phenol type cyan coupler represented by the above formula [XIII a] or [XIII b] and the cyan dye formed from said cyan coupler, for example, aliphatic groups, aromatic groups or heterocyclic groups, preferably alkyl groups having 4 to 30 carbon atoms, aryl groups or heterocyclic groups. For example, there may be included straight or branched alkyl groups (e.g. t-butyl, n-octyl, t-octyl, n-dodecyl, etc.), alkenyl groups, cycloalkyl groups, 5- or 6-membered heterocyclic groups.

$R_{31}$ is preferably group represented by the following formula [XIII c]:

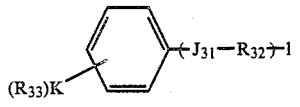

In the above formula, $J_{31}$ represents an oxygen atom or a sulfur atom, K an integer from 0 to 4, l represents 0 or 1 and, when K is 2 or more, $R_{31}$ existing in number of 2 or more may be either the same or different. $R_{32}$ represents a straight or branched alkylene group having 1 to 20 carbon atoms, and $R_{33}$ represents a monovalent group, including a hydrogen atom, a halogen atom (preferably chlorine, bromine), an alkyl group {preferably a straight or branched alkyl group having 1 to 20 carbon atoms (e.g. methyl, t-butyl, t-pentyl, t-octyl, dodecyl, pentadecyl, benzyl, phenetyl)}, an aryl group (e.g. phenyl), a heterocyclic group (preferably a nitrogen-containing heterocyclic group), an alkoxy group {preferably a straight or branched alkoxy group having 1 to 20 carbon atoms (e.g. methoxy, ethoxy, t-butyloxy, octyloxy, decyloxy, dodecyloxy)}, an aryloxy group (e.g. phenoxy), hydroxy, an acyloxy group {preferably an alkylcarbonyloxy group, arylcarbonyloxy group (e.g. acetoxy, benzoyloxy)}, carboxy, an alkyloxycarbonyl group (preferably a straight or branched alkyloxy carbonyl group having 1 to 20 carbon atoms), an aryloxycarbonyl group (preferably phenoxycarbonyl), an alkylthio group (preferably an alkylthio group having 1 to 20 carbon atoms), an acyl group (preferably a straight or branched alkylcarbonyl group having 1 to 20 carbon atoms), an acylamino group (preferably a straight or branched alkylcarboamide having 1 to 20 carbon atoms, benzenecarboamide), a sulfonamide group (preferably a straight or branched alkylsulfonamide group having 1 to 20 carbon atoms, a benzenesulfonamide group), a carbamoyl group (preferably a straight or branched alkylaminocarbonyl group having 1 to 20 carbon atoms, phenylaminocarbonyl group), a sulfamoyl group (preferably a straight or branched alkylaminosulfonyl group having 1 to 20 carbon atoms, phenylaminosulfonyl group), etc.

In the formula [XIII a] and [XIII b], $X_{31}$ represents a hydrogen atom or an eliminable group during the coupling reaction with the oxidized product of a color developing agent. Such an eliminable group may be, for example, a halogen atom (e.g. chlorine, bromine, fluorine), an aryloxy, carbamoyloxy, carbamoylmethoxy, acyloxy, sulfonamide and succinimide groups in which the oxygen atom or nitrogen atom is bonded directly to the coupling position. Further, specific examples of such an eliminable group include those disclosed in U.S. Pat. No. 3,741,563, Japanese Unexamined Patent Publication No. 37425/1972, Japanese Patent Publication No. 36894/1973, Japanese Unexamined Patent Publications Nos. 10135/1975, 117422/1975, 130441/1975, 108841/1976, 120334/1975, 18315/1977, 105226/1978, 14736/1979, 48237/1979, 32071/1980, 65957/1980, 1938/1981, 12643/1981 and 27147/1981.

The ureido type cyan coupler according to this invention can be synthesized by the method as disclosed in U.S. Pat. No. 3,758,308 and Japanese Unexamined Patent Publication No. 65134/1981.

Specific examples of the preferable ureido type cyan couplers according to this invention are enumerated below, but this invention is not limited by these.

(C-1)
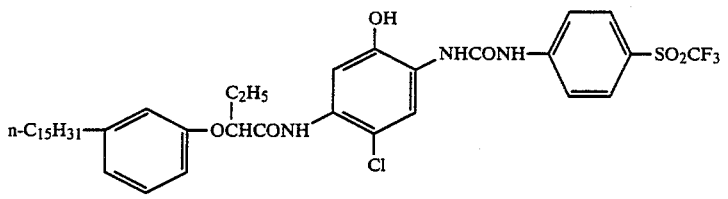
(C-2)
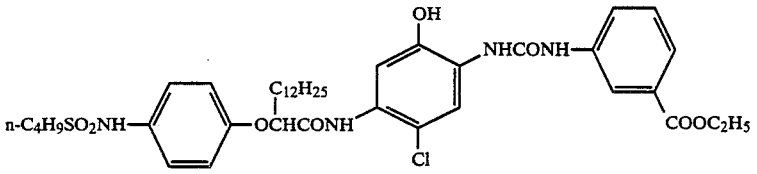
(C-3)
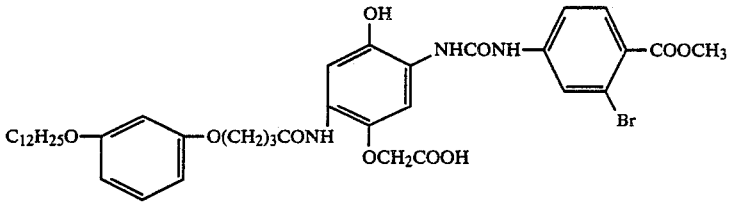
(C-4)
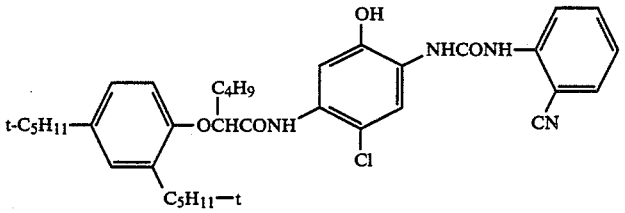
(C-5)
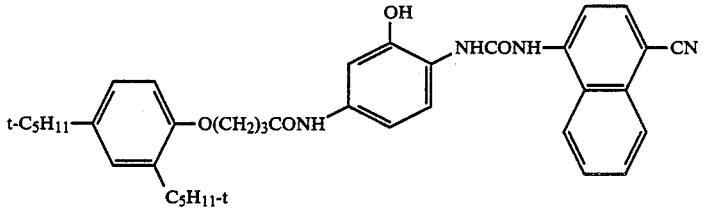
(C-6)
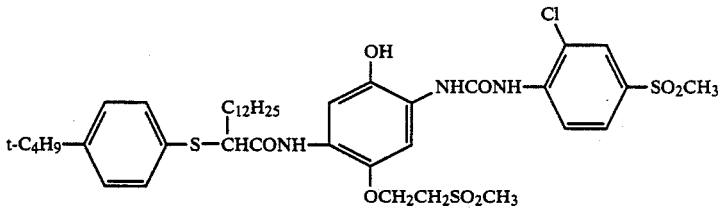
(C-7)
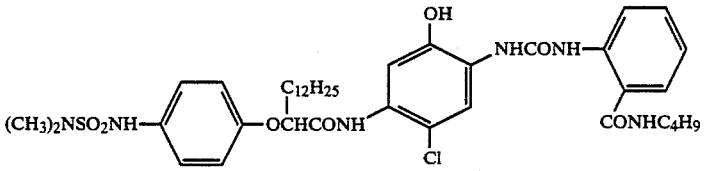

-continued
(C-8)
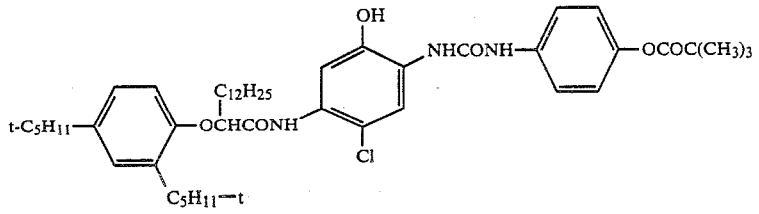
(C-9)
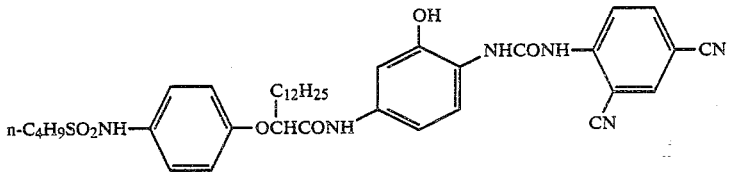
(C-10)
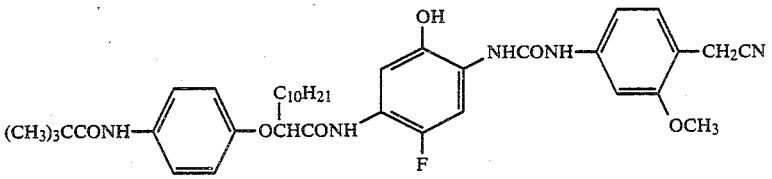
(C-11)
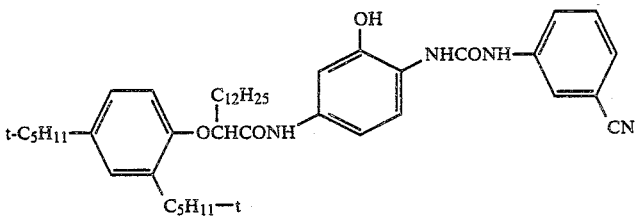
(C-12)
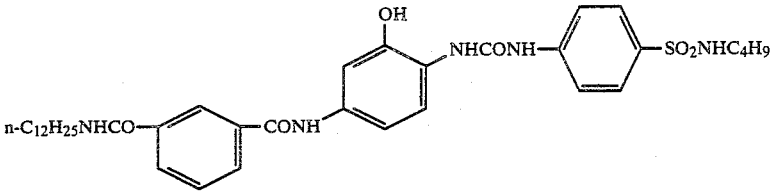
(C-13)
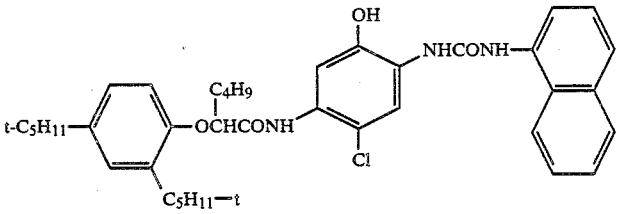
(C-14)
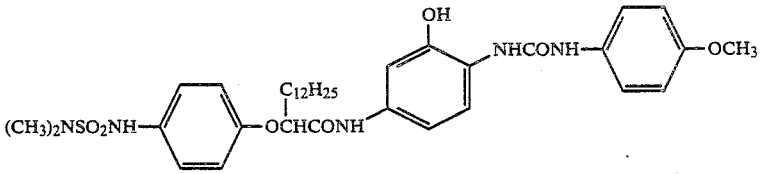

-continued
(C-15)
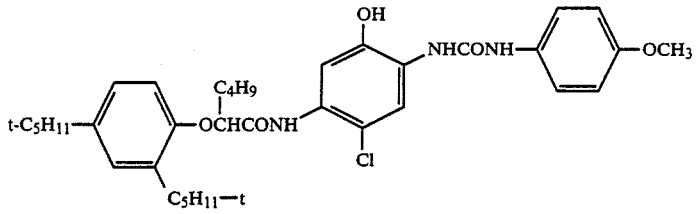
(C-16)
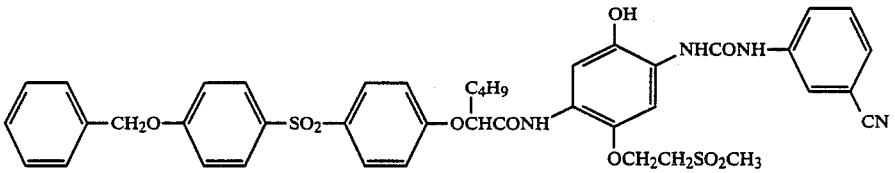
(C-17)
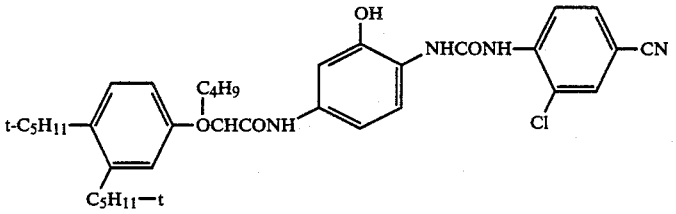
(C-18)
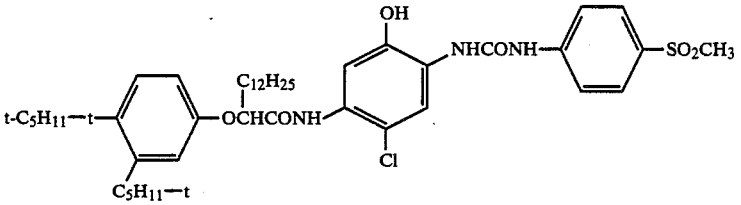
(C-19)
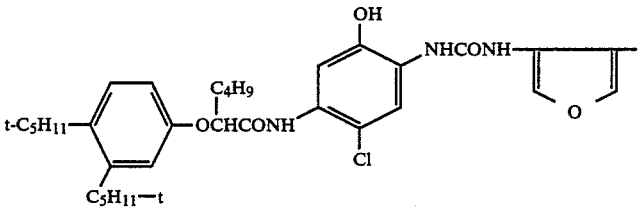
(C-20)
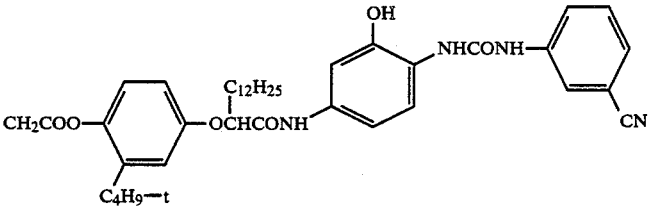
(C-21)
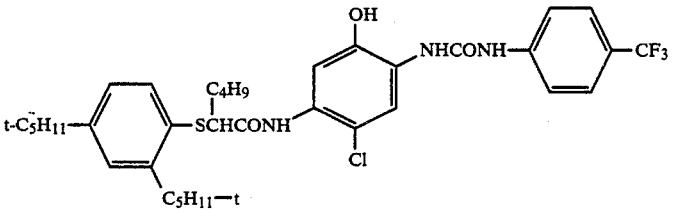

-continued
(C-22)
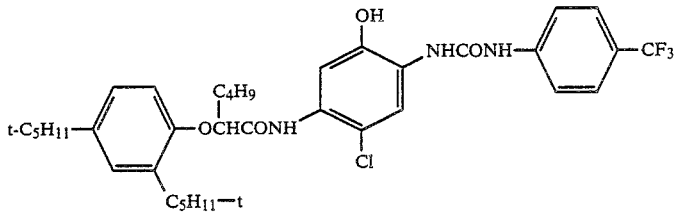
(C-23)
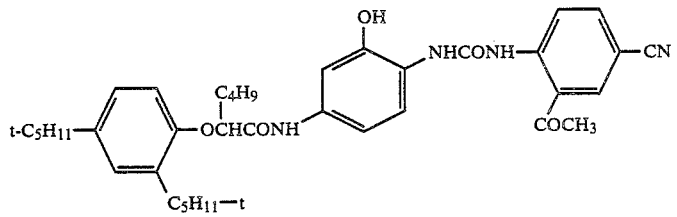
(C-24)
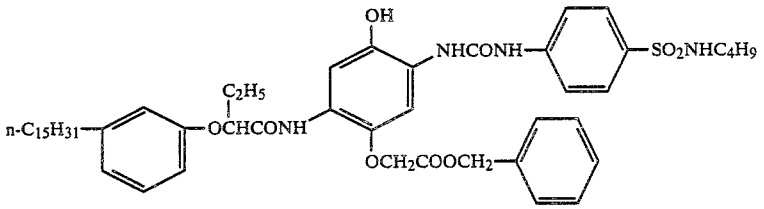
(C-25)
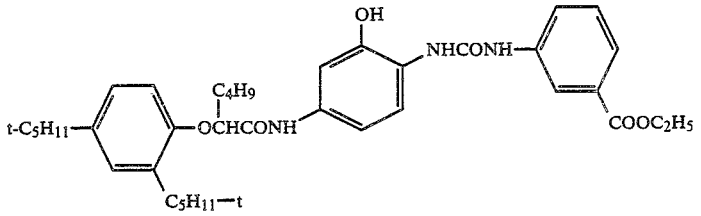
(C-26)
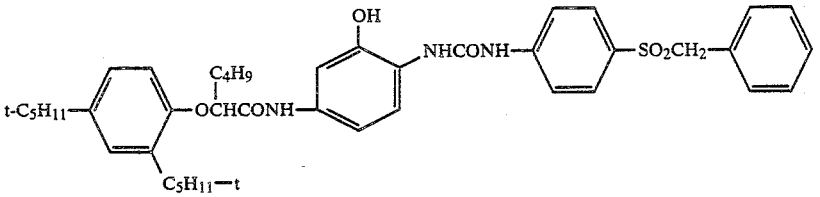
(C-27)
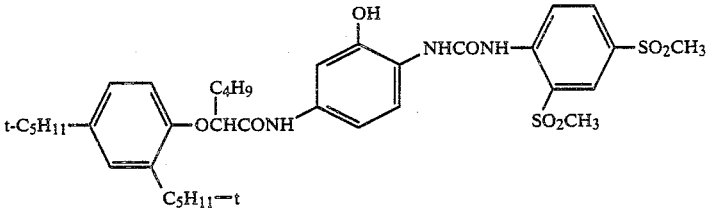
(C-28)
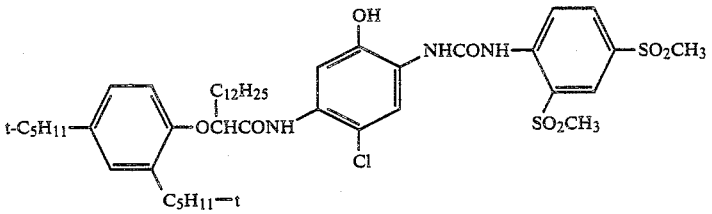

-continued
(C-29)
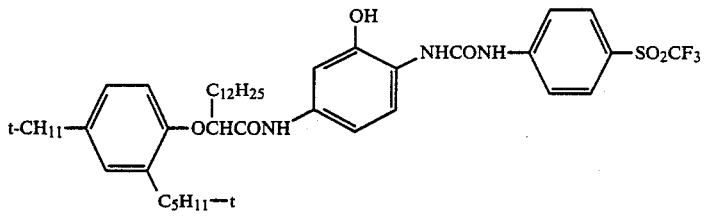
(C-30)
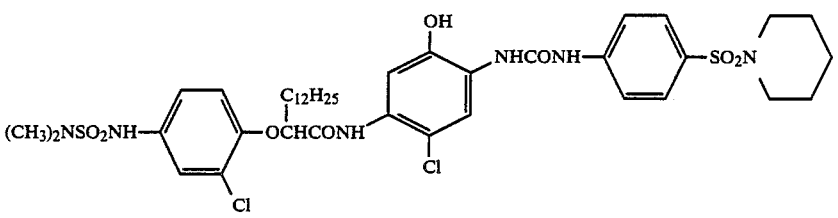
(C-31)
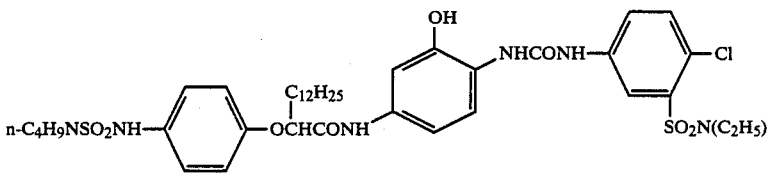
(C-32)
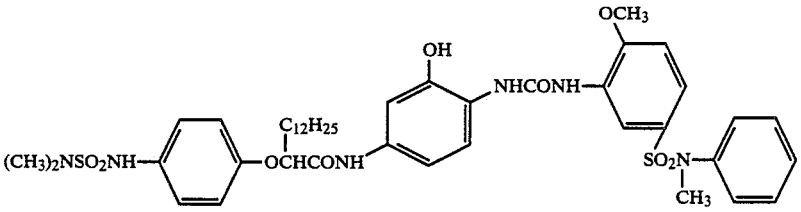
(C-33)
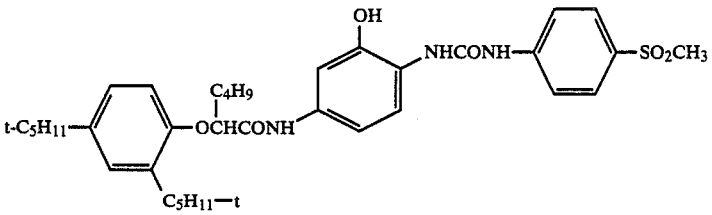
(C-34)
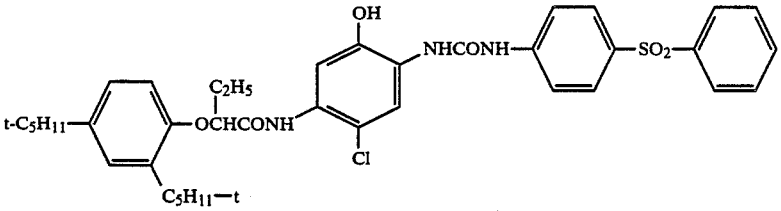
(C-35)
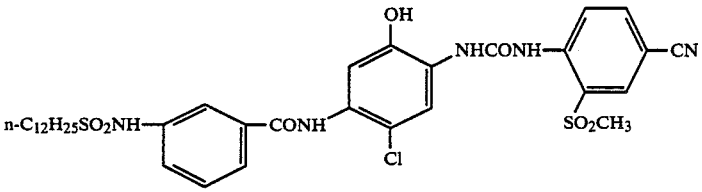

-continued
(C-36)
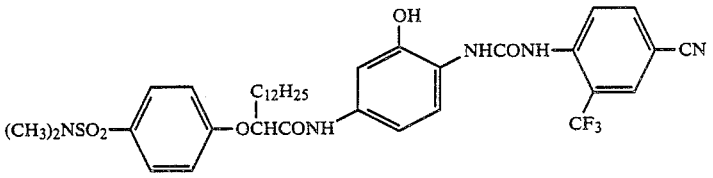
(C-37)
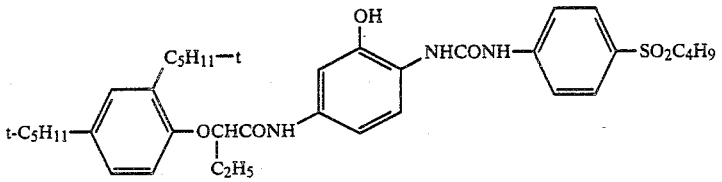
(C-38)
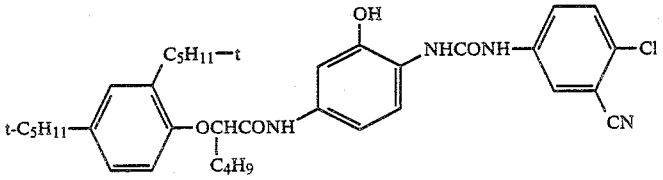
(C-39)
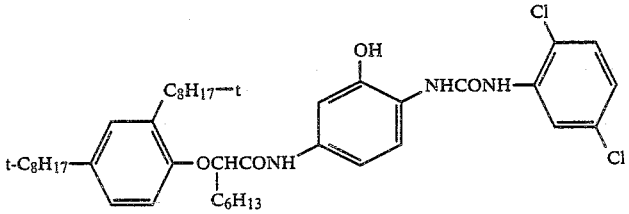
(C-40)
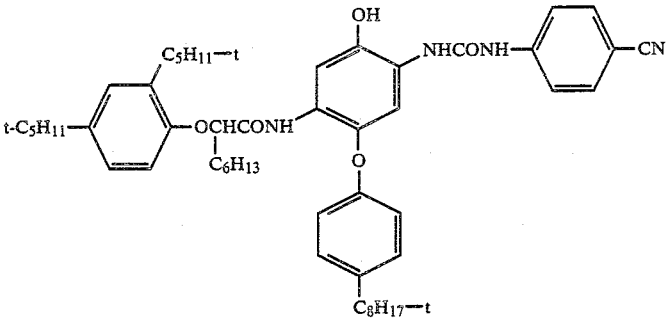
(C-41)
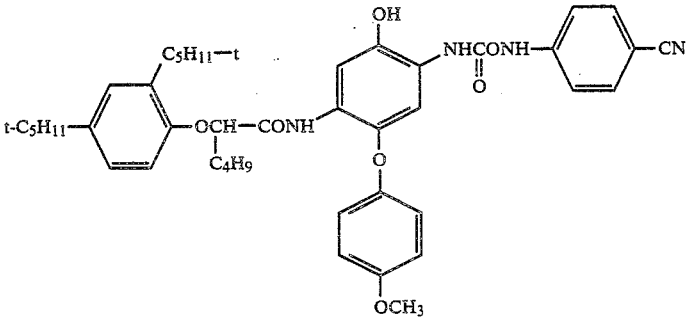

-continued (C-42)

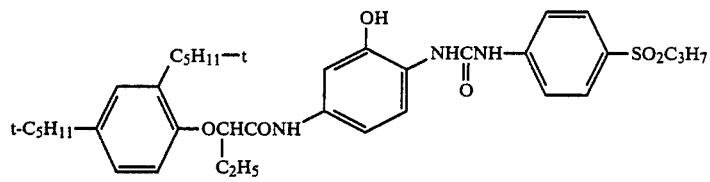

The silver halides contained in the high sensitive layer of the green-sensitive silver halide emulsion layers (GH) constituting green-sensitive layers of light-sensitive silver halide color photographic emulsion of this invention and/or the high sensitive layer of the red-sensitive silver halide emulsion layers (RH) should preferably have a mean grain size of 0.40 to 3.00 μm, more preferably 0.50 to 2.50 μm.

The silver halide contained in the low sensitive layer of said green-sensitive silver halide emulsion layer (GL) and/or the low sensitive layer of the red-sensitive silver halide emulsion layer (RL) should preferably have a mean grain size of 0.20 to 1.50 μm, more preferably 0.20 to 1.00 μm. When the low sensitive layer of the green sensitive silver halide emulsion layer (GL) and/or low sensitive layer of the red-sensitive silver halide emulsion layer (RL) is separated into medium sensitive layer and low sensitive layer, the former should preferably have a mean grain size of 0.30 to 1.50 μm, and the latter 0.15 to 1.00 μm. Further, it is also possible to use a mixture of 2 or more kinds of light-sensitive silver halide emulsions with different mean particle sizes in each low sensitive layer.

In this case, as disclosed in Japense Unexamined Patent Publication No. 74548/1984, the content of silver iodide in the silver halide should preferably be higher in the emulsion with smaller mean particle size. A more preferred embodiment is the case when the light-sensitive silver halide emulsion contained in the low sensitive green-sensitive emulsion layer and/or the low sensitive red-sensitive emulsion layer comprises substantially 1 kind of mono-dispesed silver halide emulsion. In this case, the prior art technique had the drawback of narrowed latitude of exposure, although graininess can be improved as compared with the case when employing a mixture of plural kinds of silver halide emulsions. In contrast, by use of the benzoyl type coupler, the pyrazolotriazole type coupler and the ureido type coupler in combination, latitude can be broadened markedly. Particularly, this effect is great in the low sensitive green-sensitive emulsion layer.

The mean grain size of the silver halide contained in the light-sensitive silver halide emulsion layer of this invention can be measured according to various methods generally employed in this field of art for the above purpose. Typical methods are disclosed in Lapland "Grain Size Analytical method", A.S.T.M. Symposium on Light Microscopy, 1955, pp. 94–122 or "Theory of Photographic Process" by Mieth and James, third edition, published by Macmillan Co. (1966), Chapter 2. The grain size can be measured from the projected area of the grain by use of the approximate value of diameter. When the grains have substantially uniform shapes, the grain size distribution can be expressed considerably accurately as the diameter or the projected area.

The silver halide to be used in this invention may be a poly-dispersed emulsion in which mean grain sizes are distributed in a broad range but it is preferably mono-dispersed emulsion.

The above mono-dispersed silver halide grains in the green-sensitive silver halide emulsion layer and/or the red-sensitive silver halide emulsion layer of this invention refer to those which appear to have the same shape in most of the silver halide grains when the emulsion is observed by an electron microscope photograph, regular in grain sizes and also have the grain size distribution as described below. That is, the value obtained by dividing the standard deviation s of the grain size distribution by mean grain size $\bar{r}$ should preferably be 0.20 or less, more preferably 0.15 or less.

$$\frac{s}{\bar{r}} \leqq 0.20 \left( \text{preferably } \frac{s}{\bar{r}} \leqq 0.15 \right)$$

The grain size mentioned here has the same meaning as the grain size for the above mean grain size, and it is the diameter in the case of spherical silver halide grains or the diameter when calculated for the circle image with the same area of the projected image in the case of grains with cubic or other shapes than spheres. The individual grain size in this sense is ri, and when their number is ni, $\bar{r}$ is defined by the following formula.

$$\bar{r} = \frac{\Sigma ni \cdot ri}{\Sigma ni}$$

The relationship of grain size distribution can be determined according to the method described in the essay of Tribel and Smith "Empirical Relationship between Sensitometry Distribution and Grain Size Distribution in Photography", the Photographic Journal, vol. LXXIX, 1949, pp. 330–338.

As a preferable embodiment of this invention, the mono-dispersed silver halide grains to be contained in at least one layer of the high sensitive blue-sensitive silver halide emulsion layer, green-sensitive silver halide emulsion layer and red-sensitive silver halide emulsion layer may be a mixture of 2 or more kinds and, in this case, their mean grain sizes may be either the same or different. Also, poly-dispersed silver halide grains may be used within the range which dose not impair the effect of this invention.

The silver halide contained in the green-sensitive silver halide emulsion layer and the red-sensitive silver halide emulsion layer may be either one of silver iodobromide, silver chlorobromide, silver bromide, silver chloride, silver chloroiodobromide or mixtures thereof, but preferably silver iodobromide. The content of silver iodide should preferably be 15 mol % or less.

The silver halide contained in the high sensitive layer of the blue-sensitive silver halide emulsion layer (BH) should also preferably be mono-dispersed like the silver halide contained in the high sensitive layer of the green-sensitive silver halide emulsion layer (GH) and the high sensitive layer of the red-sensitive silver halide emulsion layer (RH).

The composition of the silver halide contained in the blue-sensitive silver halide emulsion is not particularly limited, but any of silver chloride, silver bromide, silver chlorobromide, silver chloroiodobromide, etc., or a mixture thereof may be used, but it is preferably silver iodobromide, with the content of silver iodide being 4 mol % or higher.

The mean grain size of silver halide contained in the blue-sensitive silver halide emulsion layer is not particularly limited, but the mean grain size of the silver halide contained in the high sensitive layer of the blue-sensitive silver halide emulsion layer (BH) is 0.40 to 3.00 μm, preferably 0.50 to 2.50 μm, and the mean grain size of the silver halide contained in the low sensitive layer of the blue-sensitive silver halide emulsion layer (BL) is preferably 0.20 to 1.50 μm.

The amount of silver in the high sensitive layer of the blue-sensitive silver halide emulsion layer (BH), the high sensitive layer of the green-sensitive silver halide emulsion layer (GH) and the high sensitive layer of the red-sensitive silver halide emulsion layer in the light-sensitive silver halide color photographic material of this invention (attached silver amount) is preferably each 0.5 to 3 $g/m^2$, more preferably 1 to 2.5 $g/m^2$. On the other hand, the amount of silver in the low sensitive layer of the blue-sensitive silver halide emulsion layer (BL), the low sensitive layer of the green-sensitive silver halide emulsion layer (GL) and the low sensitive layer of the red-sensitive silver halide emulsion layer (attached silver amount) is each preferably 0.5 to 3 $g/m^2$, more preferably 1 to 2.5 $g/m^2$.

The crystals of these silver halide grains may be either normal crystals, twin crystal or others, and crystals with any desired ratio of [1.0.0] plane to [1.1.1] plane may be available. Further, the crystalline structure of these silver halide grains may be uniform from the inner portion to the outer portion, or consist of a layer structure in which the inner portion and the outer portion are different from each other (core-shell type). Also, these silver halides may be either of the type in which latent images are formed mainly on their surfaces or of the type in which latent images are formed internally of the grains. In this case, it is preferable that the silver iodide content in the silver halide in the core portion (inner side) should be higher than that in the shell portion (outer side). Further, silver halide grains shaped in flat plates as described in Japanese Unexamined Patent Publication No. 127921/1983, Research Disclosure (RD) 23212 can also be used.

The silver halide grains to be used in this invention may be obtained according to any preparation method well known in the art such as the acidic method, the neutral method or the ammonia method.

For example, there may be employed the method in which seed grains are prepared by the acidic method, and further the see grains are grown by the ammonia method with rapid growth speed to desired sizes. When the silver halide grains are grown, it is preferable to control pH, pAg, etc. in a reactor and inject successively at the same time silver ions and halide ions in amounts corresponding to the growth speed of the silver halide grains as described in, for example, Japanese Unexamined Patent Publication No. 48521/1979.

Preparation of sivler halide grains according to the present invention should preferably be conducted as described above. The composition containing said silver halide grains is referred to as silver halide emulsion in the present specification.

These silver halide emulsions may be chemically sensitized with a single sensitizer or a suitable combination of sensitizers (e.g. combination of a gold sensitizer and a sulfur sensitizer, combination of a gold sensitizer and a selenium sensitizer. Such sensitizers may include activated gelatin; sulfur sensitizers such as arylthiocarbamide, thiourea, cystine, etc.; selenium sensitizers; reducing sensitizers such as stannous salts, thioureaa dioxide, polyamines, etc.; noble metal sensitizers such as gold sensitizers, specifically potassium aurithiocyanate, potassium chloroaurate, 2-aurothio-3-methylbenzothiazolium chloride, etc., or sensitizers of water soluble salts of, for example, ruthenium, palladium, platinum, rhodium, iridium, etc., specifically ammonium chloropalladate, potassium chloroplatinate, sodium chloropalladate (some of these may act as sensitizers or fogging inhibitors depending on the amount), etc.

The silver halide emulsion according to this invention may be prepared by carrying out chemical aging with addition of a sulfur-containing compound and incorporating at least one of hydroxytetrazaindene and nitrogen-containing heterocyclic compounds having mercapto group before, during or after the chemical aging.

The silver halides to be used in this invention may also be optically sensitized with addition of $5\times10^{-8}$ to $3\times10^{-3}$ mole of a suitable sensitizing dye in order to impart photosensitivity to the respective desired photosensitive wavelength regions. As the sensitizing dye, various dyes can be used and a combination with one dye or two or more dyes can also be used. The sensitizing dyes which can be advantageously used in this invention are mentioned below.

That is, as the sensitizing dye to be used in the blue-sensitive silver halide emulsion, there may be included those as disclosed in West German Pat. No. 9 29 080; U.S. Pat. Nos. 2,231,658, 2,493,748, 2,503,776, 2,519,001, 2,912,329, 3,656,959, 3,672,897, 3,694,217, 4,025,349 and 4,046,572; U.K. Pat. No. 1,242,588; Japanese Patent Publications Nos. 14030/1969 and 24844/1977. As the sensitizing dye to be used in the green-sensitive silver halide emulsion, there may be included cyanine dyes, merocyanine dyes or complex cyanine dyes as disclosed in, for example, U.S. Pat. Nos. 1,939,201, 2,072,908, 2,739,149, 2,945,763; and U.K. Pat. No. 505,979, as representative ones. Further, as the sensitizing dye to be used in the red-sensitive silver halide emulsion, there may be included cyanine dyes, merocyanine dyes or complex cyanine dyes as disclosed in, for example, U.S. Pat. Nos. 2,269,234, 2,270,378, 2,442,710, 2,454,629 and 2,776,280, as representative ones. Furthermore, cyanine dyes, merocyanine dyes or complex cyanine dyes as disclosed in U.S. Pat. Nos. 2,213,995, 2,493,748 and 2,519,001 and West German Pat. No. 9 29 080 can also advantageously be used in the green-sensitive silver halide emulsion or the red-sensitive silver halide emulsion.

These sensitizing dyes may be used either singly or as a combination of these.

The light-sensitive photographic material of this invention may also be subjected to optical sensitization to a desired wavelength region according to the spectral sensitizing method by using cyanine or merocyanine dyes either singly or in combination.

Typical examples of the particularly preferred spectral sensitizing methods may include those concerning the combination of benzimidazolocarbocyanine and benzooxazolocarbocyanine as disclosed in Japanese Patent Publications Nos. 4936/1968, 22884/1968, 18433/1970, 37443/1972, 28293/1973, 6209/1974, 12375/1978; Japanese Unexamined Patent Publications Nos. 23931/1977, 51932/1977, 80118/1979, 153926/1983, 116646/1984, 116647/1984, etc.

Concerning the combination of carbocyanine having benzimidazole nucleus and other cyanines or merocyanine, there may be included, for example, Japanese Patent Publications Nos. 25831/1970, 11114/1972, 25379/1972, 38406/1973, 38407/1973, 34535/1979, 1569/1980; Japanese Unexamined Patent publications Nos. 33220/1975, 38526/1975, 107127/1976, 115820/1976, 135528/1976, 104916/1977, 104917/1977, etc.

Further, concerning the combination of benzooxazolocarbocyanine (oxa-carbocyanine) and other carbocyanines, there may be included, for example, Japanese Patent Publications Nos. 32753/1969, 11627/1971; Japanese Unexamined Patent Publication No. 1483/1982; and, concerning the combination with merocyanine, there may be included Japanese Patent Publications Nos. 38408/1973, 41204/1973, 40662/1975; Japanese Unexamined Patent publications Nos. 25728/1981, 10753/1983, 91445/1983, 116645/1984 and 33828/1975.

Also, concerning the combination of thiacarbocyanine with other carbocyanines, there may be included, for example, Japanese Patent Publications Nos. 4932/1968, 4933/1968, 26470/1970, 18107/1971, 8741/1972; Japanese Unexamined Patent Publication No. 114533/1984. Further, it is possible to use advantageously the method as disclosed in Japanese Patent Publication No. 6207/1974 using zeromethyne, dimethynemelocyanine, monomethyne or trimethynecyanine and a styryl dye.

For addition of these sensitizing dyes into the silver halide emulsion according to this invention, they can be used as the dye solutions by dissolving them previously in hydrophilic organic solvents such as methyl alcohol, ethyl alcohol, acetone, dimethylformamide or fluorinated alcohols as disclosed in Japanese Patent Publication No. 40659/1975.

The timing of addition may be either at initiation of chemical aging of the silver halide emulsion, during the chemical aging or on completion of the chemical aging. In some cases, they can be added also in the step immediately before coating of the emulsion.

In the light-sensitive silver halide color photographic material of this invention, there may also be incorporated water-soluble dyes as filter dyes in hydrophilic colloid layers or for various other purposes such as irradiation prevention, etc. Such dyes may include oxonol dyes, hemioxonol dyes, merocyanine dyes and azo dyes. Among them, oxonol dyes, hemioxonol dyes and merocyanine dyes are useful. Specific examples of available dyes are disclosed in U.K. Pat. Nos. 584,609 and 1,277,429; Japanese Unexamined Patent Publications Nos. 85130/1973, 99620/1974, 114420/1974, 129537/1974, 108115/1977, 25845/1984; U.S. Pat. Nos. 2,274,782, 2,533,472, 2,956,879, 3,125,448, 3,148,187, 3,177,078, 3,247,127, 3,540,887, 3,575,704, 3,653,905, 3,718,472, 4,071,312 and 4,070,352.

In the silver halide emulsion layer or other photographic constituent layers according to this invention, couplers, namely, the compounds capable of forming dyes through the reaction with the oxidized product of a color developing agent can be mentioned, respectively.

In the green-sensitive emulsion layer of this invention, conventional colored magenta couplers can be used. As the colored magenta coupler, those disclosed in U.S. Pat. Nos. 2,801,171 and 3,519,429 and Japanese Patent Publication No. 27930/1973 can be used.

The colored magenta couplers particularly preferably used are shown below.

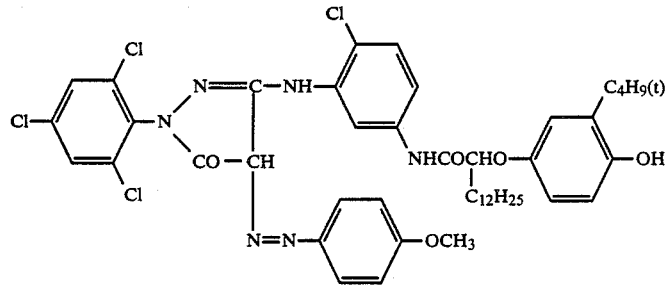

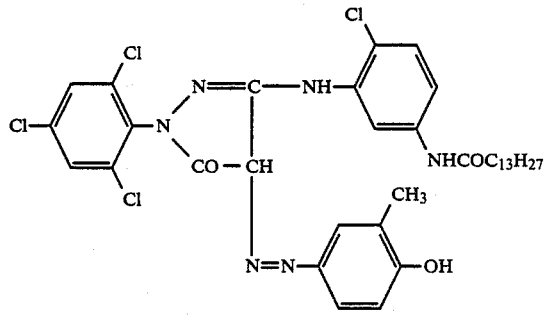

-continued

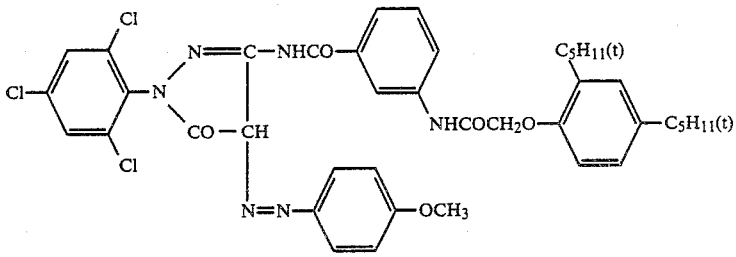

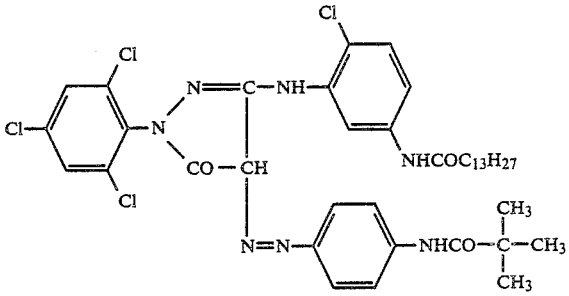

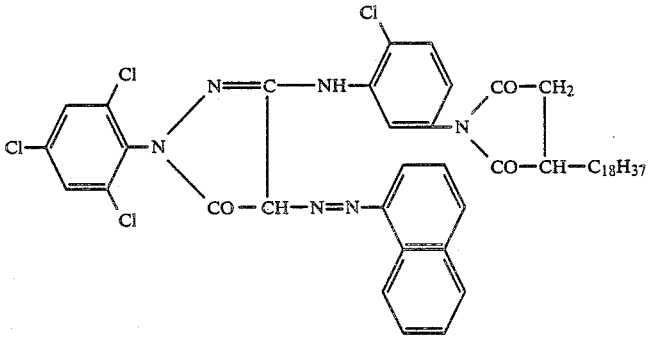

In the red-sensitive silver halide emulsion of this invention, conventional colored cyan couplers can be used. As the colored cyan coupler, those disclosed in Japanese patent publication No. 32461/1980 and U.K. Pat. No. 1,084,480 can be used.

Particularly preferable colored cyan couplers are shown below.

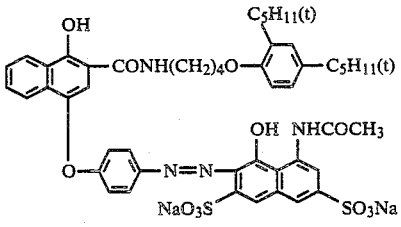

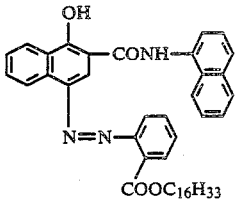

-continued

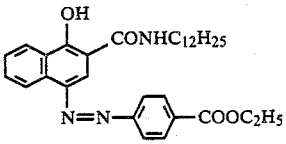

As the non-diffusive coupler capable of forming a diffusive dye appropriately blurring a dye image through the reaction with the oxidized product of a color developing agent, there is the compound represented by the formula [A] shown below:

$$(Cp)_a X \qquad \text{Formula [A]}$$

wherein Cp represents a coupler diffusible for improvement of graininess by giving rise appropriately blurring of color image, X represents a group eliminable through the reaction with the oxidized product of a color developing agent bonded to the coupler component at the coupling position and is a component containing a ballast group having 8 to 32 carbons atoms, and a represents 1 or 2.

These compounds are described in, for example, Japanese Unexamined patent publications Nos. 131936/1984, 205151/1983 and 82837/1982, and may be preferably used.

Typical examples of the DIR compounds to be preferably used in this invention are DIR couplers in which a group capable of forming a compound having development inhibiting action on elimination from the active site is introduced into the active site, as disclosed in U.K. Pat. No. 935,454, U.S. Pat. Nos. 3,227,554, 4,095,984 and 4,149,886, Japanese Unexamined patent publication No. 151944/1982, etc. The above DIR couplers have the property such that the coupler mother nucleus forms a dye, while releasing a development inhibitor, during the coupling reaction with the oxidized product of a color developing agent. Also included in this invention are compounds which can release a development inhibitor but do not form a dye during the coupling reaction with the oxidized product of a color developing agent as disclosed in U.S. Pat. Nos. 3,652,345, 3,928,041, 3,958,993, 3,961,959 and 4,052,213, Japanese Unexamined patent publication Nos. 110529/1978, 13333/1979 and 161237/1980, etc.

Furthermore, it is also possible to use the so called timing DIR compound, which is a compound reacting with the oxidized product of a color developing agent, with the mother nucleus forming a dye or a colorless compound, while the timing group eliminated releasing a development inhibitor through the intramolecular nucleophilic substitution reaction or elimination reaction, as disclosed in Japanese Unexamined patent publication Nos. 145135/1979, 114946/1981 and 154234/1982.

Also included in this invention are timing DIR compounds having the timing group as described above bonded to the coupler mother nucleus which forms a completely diffusible dye on reaction with the oxidized product of a color developing agent, as disclosed in Japanese Unexamined patent publication Nos. 160954/1983 and 162949/1983.

More preferable DIR compounds are represented by the formulae (B) and (C) shown below and, of these, the most preferable DIR compound is represented by the formula (C) shown below.

DIR compound: Formula (B)

Coup-inhibitor

In the formula, Coup is a coupler component (compound) capable of coupling with the oxidized product of a color developing agent and include, for example, a closed-chain ketomethylene compound such as acylacetanilides, acylacetates, etc; dye forming couplers such as pyrazolones, pyrazolotriazoles, pyrazolinobenzimidazoles, indazolones, phenols, naphthols, etc.; and coupling components forming substantially no dye such as acetophenones, indanones, oxazolones, etc.

On the other hand, the inhibitor in the above formula is a component (compound) which is eliminated by the reaction with a color developing agent and inhibits development of silver halide, and preferable compounds include heterocyclic compounds and heterocyclic mercapto compounds such as benztriazole, 3-octylthio-1,2,4-triazole and the like.

Examples of the above heterocyclic group include tetrazolyl, thiadiazolyl, oxadiazolyl, thiazolyl, oxazolyl, imidazolyl and triazolyl groups. Specifically, there are 1-phenyltetrazolyl, 1-ethyltetrazolyl, 1-(4-hydroxyphenyl)tetrazolyl, 1,3,4-thiazolyl, 5-methyl-1,3,4-oxadiazolyl, benzthiazolyl, benzooxazolyl, benzimidazolyl, 4H-1,2,4-triazolyl groups and the like.

In the above formula (B), the inhibitor is bonded to the active site of Coup.

DIR compound: Formula (C)

Coup-TIME-inhibitor

In the above formula, the inhibitor is the same as defiend in the above formula (B). On the other hand, Coup is also inclusive of the same coupler component capable of forming a completely diffusible dye as defiend in the formula (B). TIME can be represented by the formulae (D), (E), (F) and (G) shown below, but it is not limited only thereto.

DIR compound: Formula (D)

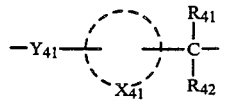

wherein $X_{41}$ represents a group atoms necessary for completion of a benzene ring or a naphthalene ring; $Y_{41}$ represents —O—, —S— or

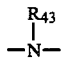

(where $R_{43}$ represents a hydrogen atom, an alkyl group or an aryl group), and is bonded to the coupling position; each of $R_{41}$ and $R_{42}$ represent a group having the same meaning as the above $R_{43}$, with the group:

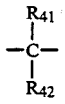

being substituted at ortho- or para-position relative to $Y_{41}$ and bonded to the hetero atom contained in the inhibitor.

DIR compound: formula (E)

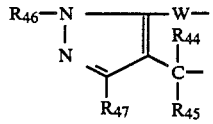

wherein W represents a group having the same meaning as $Y_{41}$ in the above formula (D); $R_{44}$ and $R_{45}$ also have the same meanings as $R_{41}$ and $R_{42}$ in the formula (C), respectively; R46 is a hydrogen atom, an alkyl group, an aryl group, an acyl group, a sulfone group, an alkoxycarbonyl group or a heterocyclic residue; $R_{47}$ represents a hydrogen atom, an alkyl group, an aryl group, a heterocyclic residue, an alkoxy group, an amino group, an acylamide group, a sulfonamide group, a carboxy group, an alkoxycarbonyl group, a carbamoyl group or a cyano group; and this timing group is bonded to the coupling position of Coup through W, and bonded to the hetero atom of the inhibitor through the group:

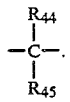

Next, an example of the timing group releasing an inhibitor through the intramolecular nucleophilic substitution reaction is shown by the formula (F).

DIR compound (F)

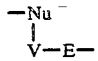

wherein Nu represents a nucleophilic group having oxygen, sulfur or nitrogen atom enriched in electrons and is bonded to the coupling position of Coup; E is an electrophilic group having a carbonyl group, thiocarbonyl group, phosphinyl group or thiophosphynyl group deficient in electrons, and is bonded to the hetero atom of the inhibitor; and V is a bonding group which defines steric relationship between Nu and E, is subject to the intramolecular nucleophilic substitution reaction with formation of 3- to 7-menbered rings after release of Nu from Coup and can thereby release an inhibitor.

DIR compound: formula (G)

Coup-OCH$_2$-inhibitor wherein Coup and inhibitor have the same meanings as defined above.

In the following, specific examples of DIR compounds are enumerated, but this invention is not limited thereby.

[Exemplary Compound of DIR]

(D-1)

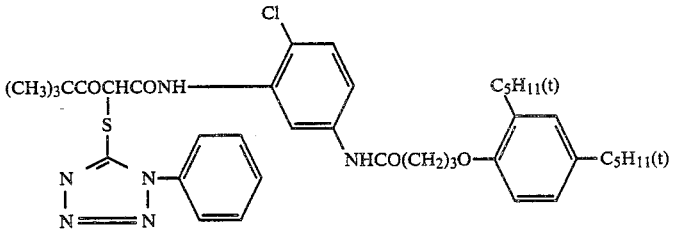

(D-2)

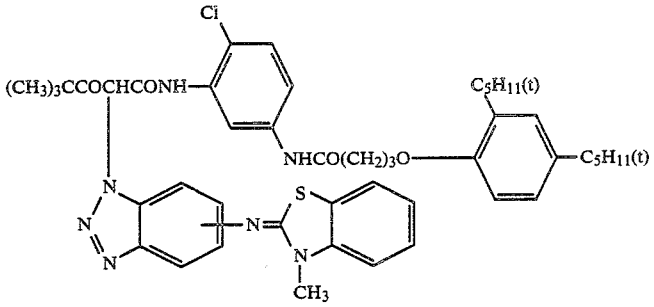

(D-3)

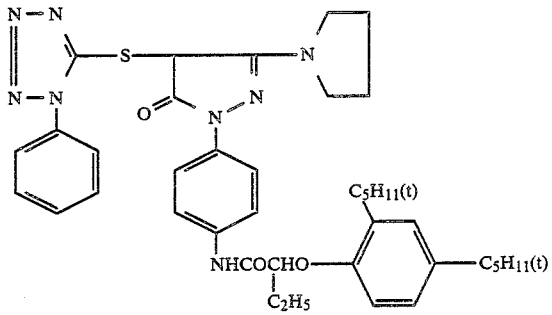

(D-4)

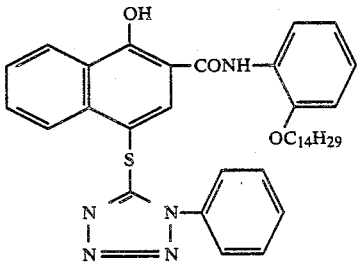

(D-5)

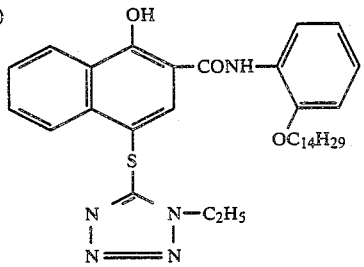

-continued
[Exemplary Compound of DIR]
(D-6)
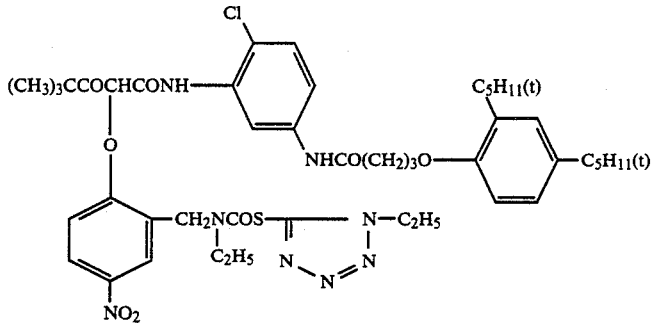
(D-7)
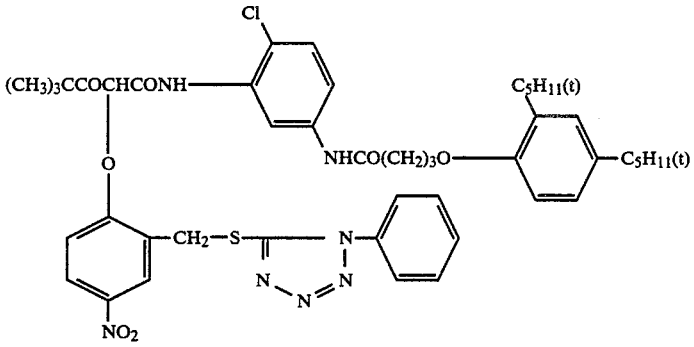
(D-8)
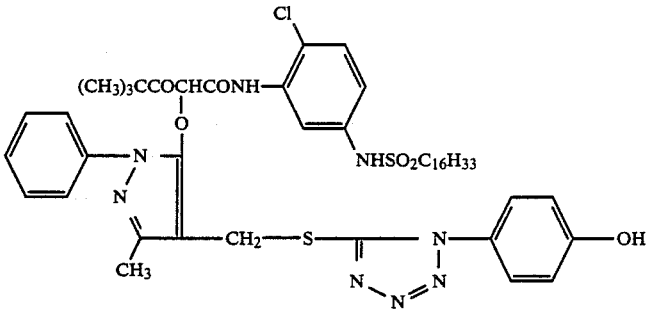
(D-9)
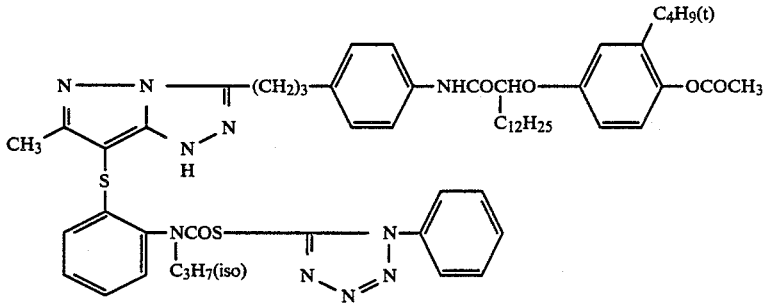
(D-10)
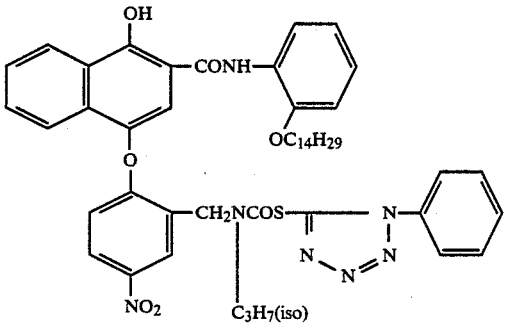
(D-11)
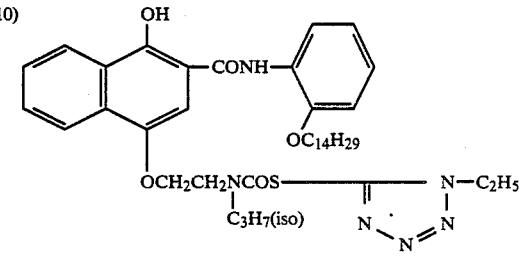

-continued
[Exemplary Compound of DIR]

(D-12)

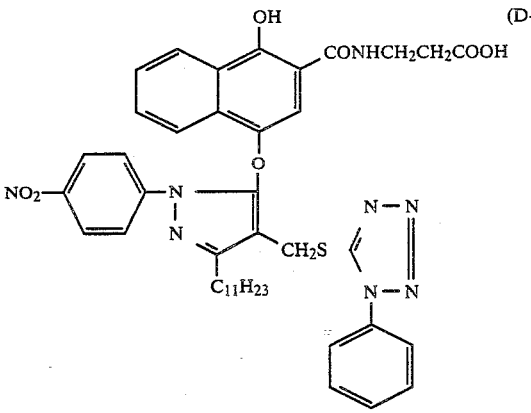

(D-13)

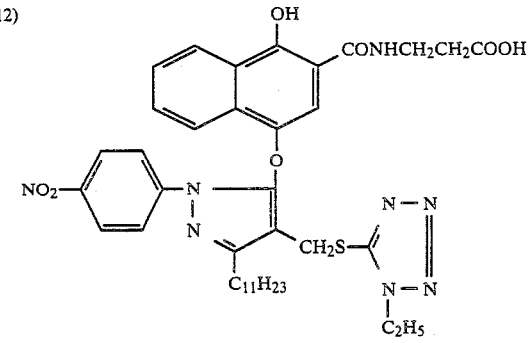

(D-14)

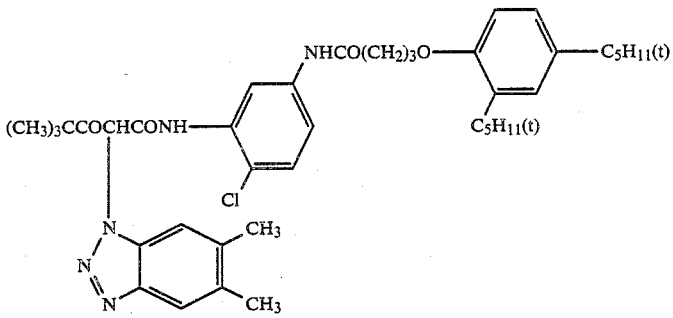

(D-15)

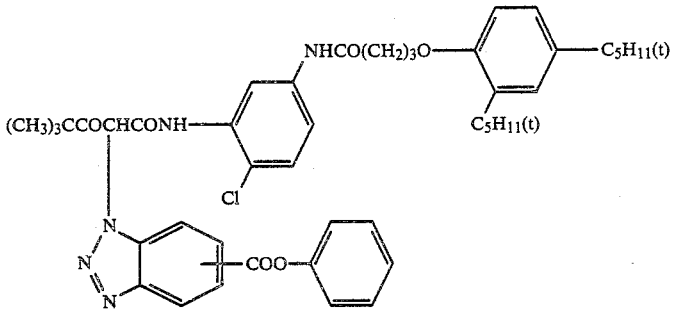

Said DIR compound should preferably be added in the light-sensitive silver halide emulsion layer.

Two or more DIR compounds may be contained in the same layer. Alternatively, the same DIR compound may be contained in two or more different layers.

These DIR compounds may be used in an amount preferably of $2\times10^{-4}$ to $5\times10^{-1}$ mole, more preferably $1\times10^{-3}$ to $1\times10^{-1}$ mole, per mole of the silver in the emulsion layer.

In this invention, the polymer couplers, etc. as disclosed in Japanese patent application No. 172151/1984 may be also used.

For incorporating these couplers, DIR compounds or the like in the silver halide emulsion according to this invention and other photographic constituent layer coating solutions, when said couplers or the like are alkali-soluble, they may be added as alkaline solutions; when they are oil-soluble, they can preferably be dissolved in a high boiling solvent, optionally together with a low boiling solvent, according to the methods as disclosed in U.S. Pat. Nos. 2,322,027, 2,801,170, 2,801,171, 2,272,191 and 2,304,940, to be dispersed in fine particles before addition into the silver halide emulsion. If desired, a hydroquinone derivative, a UV-ray absorber, a color fading preventive, etc. may also be used in combination. Also, two or more kinds of couplers may be used as a mixture. Further, to describe in detail about the method for addition of couplers, one or two or more kinds of said couplers, optionally together with other couplers, a hydroquinone derivative, a color fading preventive, a UV-ray absorber, etc., are dissolved in a high boiling solvent such as organic acid amides, carbamates, esters, ketones, urea derivatives, ethers, hydrocarbons, specifically di-n-butylphthalate, tricresyl phosphate, triphenyl phosphate, di-isooctylazelate, di-n-butylsebacate, tri-n-hexylphosphate, N,N-diethylcaprylamidobutyl, N,N-diethyllaurylamide, n-pentadecylphenylether, dioctylphthalate, n-nonylphenol, 3-pentadecylphenyl ethyl ether, 2,5-di-sec-amylphenyl butyl ether, monophenyl-di-o-chlorophenyl phosphate or fluoroparaffins, and/or a low boiling solvent such as methyl acetate, ethyl acetate, propyl acetate, butyl acetate, butyl propionate, cyclohexanol, diethyleneglycol monoacetate, nitromethane, carbon tetrachloride, chloroform, cyclohexane, tetrahydrofuran, methyl alcohol, acetonitrile, dimethylformamide, dioxane, methyl ethyl ketone, etc., the resultant solution is mixed with an aqueous solution containing an anionic surfactant such as alkylbenzenesulfonic acid and alkylnaphthalenesulofnic acid and/or a nonionic surfactant such as sorbitane sesquioleic acid ester and sorbitane monolauryl acid ester and/or a hydrophilic binder such as gelatin, etc., emulsified by means of a high speed rotary mixer, a colloid mill or a sonication dispersing device, etc. and added into the silver halide emulsion.

Otherwise, the above coupler or the like may also be dispersed by use of the latex dispersing method. The latex dispersing method and its effect are described in Japanese Unexamined patent publication Nos. 74538/1974, 59943/1976, 32552/1979 and Research Disclosure, August, 1976, No. 14850, pp. 77–79.

Suitable latices are homopolymers, copolymers or terpolymers of monomers such as styrene, acrylate, n-butyl acrylate, n-butyl methacrylate, 2-acetoacetoxyethyl methacrylate, 2-(methacryloyloxy)ethyltrimethylammoniummethosulfate, sodium 3-(methacryloyloxy)propane-1-sulfonate, N-isopropylacrylamide, N-[2-(2-methyl-4-oxopentyl)]acrylamide, 2-acrylamide-2-methylpropanesulfonic acid, etc.

In the light-sensitive sivler halide color photographic material of this invention, various kinds of other additives for photography can be contained. For example, there can be employed color staining preventives described in Japanese Unexamined patent publication No. 2128/1971 and U.S. Pat. No. 2,728,659 and antifoggants, stabilizers, UV-ray absorbers, color staining preventives, color image fading preventives, antistatic agents, film hardeners surfactants, plastifiers, wetting agents, etc. described in Research Disclosure, No. 17643. In the light-sensitive silver halide color photographic material of this invention, the hydrophilic colloid to be used for preparation of the emulsion may include any of gelatin, gelatin derivatives, graft polymer of gelatin with other polymers, proteins such as albumin, casein, etc., cellulose derivatives such as hydroxyethyl cellulose, carboxymethyl cellulose, etc., starch derivaties, synthetic hydrophilic homopolymers or copolymers such as polyvinyl alcohol, polyvinyl imidazole, polyacrylamide, etc.

As the support for light-sensitive silver halide color photographic material of this invention, there may be employed transparent supports, for example, glass plate, polyester films such as cellulose acetate, cellulose nitrate or polyethyleneterephthalate, polyamide film, polycarbonate film, polystyrene film, etc. These supports may be suitably selected depending on the purpose of use of the light-sensitive material.

For coating of the emulsion layers and other constituent layers to be used in this invention, it is possible to use various coating methods such as dipping coating, air doctor coating, curtain coating, hopper coating, etc. Also, simultaneous coating of two or more layers can also be used as disclosed in U.S. Pat. Nos. 2,761,791 and 2,941,898.

The method for processing the light-sensitive photographic material using the silver halide emulsion according to this invention is not particularly limited, but all processing methods are applicable. For example, there may be employed typically any of the method in which, after color development, bleach-fixing processing is performed, followed optionally by water washing and/or stabilizing processing; the method in which, after color development, bleaching and fixing are performed separately, followed optionally by water washing and/or stabilizing processing; the method in which pre-film-hardening, neutralization, color developing, stopping fixing, water washing, bleaching, fixing, water washing, post-film-hardening and water washing are performed in this order; the method in which color developing, water washing, supplemental color developing, stopping, bleaching, fixing, water washing and stabilizing are performed in this order; the developing method in which the developed silver formed by color developing is subjected to halogenation bleach, followed by color developing again to increase the amount of the dye formed; etc.

The color developing solution to be used in processing of the silver halide emulsion layer according to this invention, which is not limitative, is an aqueous alkaline solution containing a color developing agent and having a pH preferably of 8 or higher, more preferably of 9 to 12. The aromatic primary amine developing agent as the color developing agent is a compound has a primary amino group on the aromatic ring with an ability to develop the exposed silver halide, and further a precursor capable of forming such a compound may be added.

Typical examples of the above color developing agent are p-phenylenediamine type compounds, and preferable examples include the following:

4-amino-N,N-diethylaniline, 3-methyl-4-amino-N,N-diethylaniline, 4-amino-N-ethyl-N-β-hydroxyethylaniline, 3-methyl-4-amino-N-β-hydroxyethylaniline, 3-methyl-4-amino-N-ethyl-N-β-methoxyethylaniline, 3-methyl-4-amino-N-methyl-N-β-methanesulfonamidoethylaniline, 3-methoxy-4-amino-N-ethyl-N-β-hydroxyethylaniline, 3-methoxy-4-amino-N-ethyl-N-β-methoxyethylaniline, 3-acetamido-4-amino-N,N-dimethylaniline, N-ethyl-N-β-[β-(β-methoxyethoxy)ethoxy]ethyl-3-methyl-4-aminoaniline, N-ethyl-N-β-(β-methoxyethoxy)ethyl-3-methyl-4-aminoaniline, or salts thereof such as sulfates, hydrochlorides, sulfites, p-toluensulfonates, etc.

Further, those disclosed in, for example, Japanese Unexamined patent publication Nos. 64932/1973, 131526/1975 and 95849/1976 and Bent et al, Journal of the American Chemical Society, vol. 73, pp. 3100–3125, 1951 may also be included as typical examples.

The amount of these aromatic primary amino compounds used may be determined depending on the activity of the developing solution set, and it is preferable to increase the amount used in order to increase the activity. The amount used may be within the range of from 0.0002 mole/liter to 0.7 mole/liter. Also, depending on the purpose, two or more compounds may be suitably selected and used. For example, any derised combination can freely be used such as the combination of 3-methyl-4-amino-N,N-diethylaniline with 3-methyl-4-amino-N-ethyl-N-β-methanesulfonamidoethylaniline, 3-methyl-4-amino-N-ethyl-N-β-methanesulfonamidoethylaniline with 3-methyl-4-amino-N-ethyl-N-β-hydroxyethylaniline, etc.

The color developing solution to be used in this invention can further incorporate various components conventionally added, for example, alkali agents such as sodium hydroxide, sodium carbonate, etc., alkali metal sulfites, alkali metal hydrogen sulfites, alkali metal thiocyanates, alkali metal halides, benzyl alcohol, water softeners, thickeners and development promoters, as desired.

Other additives than those as mentioned above which can be added to the above developing solution may include, for example, compounds for rapid processing solutions such as bromides (e.g. potassium bromide, ammonium bromide, etc.), alkali iodides, nitrobenzoimidazole, mercaptobenzoimidazole, 5-methyl-benzotriazole, 1-phenyl-5-mercaptotetrazole, etc., stain preventives, sludge preventives, preservatives, overlaying effect promoting agents, chelating agents, etc.

As the bleaching agent to be used in the bleaching solution or the bleach-fixing solution in the bleaching step, there have been generally known aminopolycarboxylic acids or organic acids such as oxalic acid, citric acid, etc. having metal ions such as of iron, cobalt, copper, etc. coordinated. Typical examples of the above aminopolycarboxylic acids may include the following:

Ethylenediaminetetraacetic acid,
Diethylenetriaminepentaacetic acid,
Propylenediaminetetraacetic acid,
Nitrilotriacetic acid,
Iminodiacetic acid,
Ethyletherdiaminetetraacetic acid,
Ethyelediaminetetrapropionic acid,
Disodium ethylenediaminetetraacetate,
Pentasodium diethylenetriaminepentaacetate, and
Sodium nitrilotriacetate.

The bleaching solution may also contain various additives together with the above bleaching agent. Also, when employing a bleach-fixing solution in the bleaching step, a solution with a composition containing a silver halide fixing agent in addition to the above bleaching agent is applied. Further, the bleach-fixing solution may also contain a halide compound such as potassium bromide. And, similarly as in the case of the above bleaching solution, other various additives such as pH buffering agents, defoaming agents, surfactants, preservatives, chelating agents, stabilizers, organic solvents, etc. may also be added and contained.

The silver halide fixing agent may include, for example, sodium thiosulfate, ammonium thiosulfate, potassium thiocyanate, sodium thiocyanate, or compounds capable of forming water-soluble silver salts through the reaction with silver halides conventionally used in fixing processing, such as thiourea, thioether, etc.

The processing temperature in the various processing steps such as color developing, bleach-fixing (or bleaching and fixing), further water washing, stabilizing, drying, etc. optionally conducted may preferably be 30° C. or higher from the standpoint of rapid processing.

The light-sensitive silver halide color photographic material may also be subjected to the stabilizing processing as substitute for water washing as disclosed in Japanese Unexamined patent publication Nos. 14834/1983, 105145/1983, 134634/1983 and 18631/1983, and Japanese Unexamined patent publication Nos. 126533/1984 and 233651/1985.

This invention is described by referring to the following examples, by which the embodiments of this invention are not limited.

In all of the examples shown below, the amount added in the light-sensitive silver halide color photographic material shows the amount per 1 $m^2$. Silver halide and colloidal silver are shown as calculated on silver.

EXAMPLE 1

With the layer constitution shown below, a multilayer color film sample No. 1 was prepared by providing layers on a support having a halation preventive layer coated thereon.

In the following description, Pro represents a protective layer and BS are support.

Layer constitution . . . Pro, BH, BL, YF, GH, GL, IL, RH, RL, BS.

Next the respective layers of RL, RH, GL, GH, BL, BH, IL, YF and Pro are explained.

Low sensitive layer of red-sensitive silver halide emulsion layer (RL):

low sensitive layer of a red-sensitive silver halide emulsion layer containing 1.0 g of an emulsion comprising AgBrI containing 8 mol. % of AgI on an average with a mean grain size (r) of 0.47 μm and a fractuation coefficient (s/r) of 0.12 (emulsion I) which has been color sensitized to red-sensitive, 1.0 g of an emulsion comprising AgBrI containing 8 mol % of AgI on an average with a mean grain size of 0.31 μm and a fractuation coefficient of 0.10 (emulsion II) and an emulsion having a solution of 0.07 g of 1-hydroxy-4-[4-(1-hydroxy-8-acetamido-3,6-disulfo-2-napthylazo)phenoxy]-N-[δ-(2,4-di-t-amylphenoxy)butyl]-2-naphamide disodium (called CC-A), 0.4 g of 1-hydroxy-2-[δ-(2,4-di-t-amylphenoxy)-n-butyl]naphthoamide (called C-A) and 0.06 g of a DIR compound (exemplary compound D-13) in 1.0 g of tricrezyl phosphate (called TCP) emulsified in an aqueous solution containing 2.4 g of gelatin.

High sensitive layer of red-sensitive silver halide emulsion layer (RH):

high sensitive layer of red-sensitive silver halide emulsion layer containing an emulsion comprising AgBrI containing 6 mol % of AgI on an average with a mean grain size of 0.7 μm and a fractuation coefficient of 0.12 (emulsion III) which has been color sensitized to red-sensitive, and a dispersion having a solution of 0.20 g of the cyane coupler (C-A) and 0.03 g of the colored cyane coupler (CC-A) in 0.23 g of TCP emulsified in an aqueous solution containing 1.2 g of gelatin.

Low sensitive layer of green-sensitive silver halide emulsion layer (GL):

low sensitive layer of green-sensitive silver halide emulsion layer containing 1.5 g of the emulsion I which has been color sensitized to green-sensitive, 1.5 g of the emulsion II which has been color sensitized to green-sensitive and a dispersion having a solution of 0.35 g of 1-(2,4,6-trichlorophenyl)-3-[3-(p-dodecyloxybenzenesulfoneamido)benzamido]-5-pyrazolone (called M-A), 0.10 g of 1-(2,4,6-trichlorophenyl)-4-(1-naphthylazo)-3-(2-chloro-5-octadecenylsuccinimidoanilino)-5-pyrazolone (called CM-A) and 0.04 g of the DIR compound (D-13) in 0.68 g TCP emulsified in an aqueous solution containing 2.4 g of gelatin.

High sensitive layer of green-sensitive silver halide emulsion layer (GH):

high sensitive layer of green-sensitive silver halide emulsion layer containing 2.0 g of the emulsion III which has been color sensitized to green-sensitive and a dispersion having a solution of 0.14 g of the magenta coupler (M-A) and 0.045 g of the colored magenta coupler (CM-A) in 0.27 g of TCP emulsified in an aqueous solution containing 2.4 g of gelatin.

Low sensitive layer of blue-sensitive silver halide emulsion layer (BL):

low sensitive layer of blue-sensitive silver halide emulsion layer containing 0.5 g of the emulsion I which has been color sensitized to blue-sensitive, 0.5 g of the emulsion II color sensitized to blue-sensitive and a dispersion having a solution of 0.7 of α-pivaloyl-α-(1-benzyl-2-phenyl-3,5-dioxysoimidazolydine-4-yl)-2-chloro-5-[α-dodecyloxycarbonyl)ethoxycarbonyl]acetanilide (called Y-A) and 0.02 g of the DIR compound (D-13) in 0.68 g of TCP emulsified in an aqueous solution containing 1.8 g of gelatin.

High sensitive layer of blue-sensitive silver halide emulsion layer (BH):

high sensitive layer of blue-sensitive silver halide emulsion layer containing 0.9 g of an emulsion comprising AgBrI containing 6 mol % of AgI with a mean grain size of 0.80 μm and a fluctuation coefficient of 0.14 and a dispersion having a solution of 0.25 g of yellow coupler (Y-A) in 0.25 g of TCP emulsified in an aqueous solution containing 2.0 g of gelatin.

Intermediate layer (IL):

intermediate layer containing 0.8 g of gelatin and a solution of 0.07 g of 2,5-di-t-octylhydroquinone (called HQ-1) in 0.07 g of dibutylphthalate (called DBP).

Yellow filter (YF):

yellow filter containing 0.15 g of yellow colloidal silver and a solution of 0.2 g of color staining preventive (HQ-1) in 0.11 g of DBP and 1.0 g of gelatin.

Protective layer (Pro):

gelatin protective layer of 2.3 g.

For the sample No. 1 thus prepared, the color forming couplers contained in No. 1 were varied as shown in Table 1 to prepare samples No. 2 to 7.

In the sample No. 8, the low sensitive layer of GL was all changed to a single kind mono-dispersed emulsion by changing the emulsion I and the emulsion II contained in GL to an emulsion comprising AgI containing 8 mol % of AgI on an average with a mean grain size of 0.41 μm and a fluctuation coefficient of 0.11 (emulsion IV).

Further, in the sample No. 9, the emulsions contained in BL, GL and RL were all changed to the emulsion IV.

TABLE 1

| | | Sample No. | | | | | | | | |
|---|---|---|---|---|---|---|---|---|---|---|
| | | 1 | 2 | 3 | 4 | 5 | 6 | 7 | 8 | 9 |
| | | (Comparative Example) | | | | | (This invention) | | | |
| Emulsion layer | BH | Y-A | Y-A | Y-A | Y-1 | Y-A | Y-1 | Y-2 | Y-1 | Y-1 |
| Emulsion layer | BL | Y-A | Y-A | Y-A | Y-1 | Y-1 | Y-1 | Y-2 | Y-1 | Y-1 |
| Emulsion layer | GH | M-A | M-A | M-13 | M-A | M-A | M-13 | M-1 | M-13 | M-13 |
| Emulsion layer | GL | M-A | M-A | M-13 | M-A | M-18 | M-13 | M-1 | M-13 | M-13 |
| Emulsion layer | RH | C-A | C-22 | C-A | C-A | M-A | C-22 | C-41 | C-22 | C-22 |
| Emulsion layer | RL | C-A | C-22 | C-A | C-A | C-22 | C-22 | C-41 | C-22 | C-22 |

The respective samples No. 1 to 9 thus prepared, after wedge exposure by use of white light, were subjected to the following developing processing.

| Processing steps (38° C.) | |
|---|---|
| Color developing | 3 min. 15 sec. |
| Bleaching | 6 min. 30 sec. |
| Water washing | 3 min. 15 sec. |
| Fixing | 6 min. 30 sec. |
| Water washing | 3 min. 15 sec. |
| Stabilizing | 1 min. 30 sec. |
| Drying | |

The processing solutions used in the respective processing steps had the compositions shown below.

| [Color developing solution] | |
|---|---|
| 4-amino-3-methyl-N—ethyl-N—(β-hydroxyethyl)-aniline.sulfate | 4.75 g |
| Anhydrous sodium sulfate | 4.25 g |
| Hydroxylamine.½ sulfate | 2.0 g |
| Anhydrous potassium carbonate | 37.5 g |
| Sodium bromide | 1.3 g |
| Nitrilotriacetic acid.3 sodium salt (monohydrate) | 2.5 g |
| Potassium hydroxide | 1.0 g |
| (made up to 1 liter with addition of water). | |

| [Bleaching solution] | |
|---|---|
| Ferric ammonium ethylenediamine-tetraacetate | 100.0 g |
| Diammonium ethylenediamine-tetraacetate | 10.0 g |
| Ammonium bromide | 150.0 g |
| Glacial acetic acid | 10.0 ml |
| (made up to 1 liter with addition of water, and adjusted to pH = 6.0 with ammonia water). | |

| [Fixing solution] | |
|---|---|
| Ammonium thiosulfite | 175.0 g |
| Anhydrous sodium sulfite | 8.5 g |
| Sodium metasulfate | 2.3 g |
| (made up to 1 liter with addition of water, and adjusted to pH = 6.0 with acetic acid). | |

| [Stabilizing solution] | |
|---|---|
| Formalin (37% aqueous solution) | 1.5 ml |
| Konidax (produced by Konishiroku Photo Industry K.K.) | 7.5 ml |
| (made up to 1 liter with addition of water). | |

For each of the samples obtained, by use of blue light (b), green light (g) and red light (r), residual Ag quantity, exposure latitude (LES) and RMS were measured. The results are shown in Table 2.

For the exposure latitude, as the measure indicating its broadness, the linear exposure scale (hereinafter called LES) as described in T. H. James "the Theory of the Photographic Process", fourth edition, pp. 501–502 was adopted. The greatness of LES indicates greatness of the exposure latitude.

The RMS value was indicated by 1000-fold value of the standard deviation of fluctuation in density value which occurs when the density with the minimum density of +0.8 is scanned by a microdensitometer with a circular scanning orifice size of 25 μm. The smallness of the RMS value is one measure indicating good graininess. The residual Ag quantity was determined by measuring the residual silver quantity at the maximum density portion of the film after processing according to the fluorescent X-ray method. It is indicated in mgAg per 100 $cm^2$. Much residual silver quantity means inferior processing adaptability.

TABLE 2

| | | Sample No. | | | | | | | | |
|---|---|---|---|---|---|---|---|---|---|---|
| | | 1 | 2 | 3 | 4 | 5 | 6 | 7 | 8 | 9 |
| | | (Comparative Example) | | | | | (This invention) | | | |
| LES | b | 2.1 | 2.1 | 2.1 | 2.2 | 2.4 | 2.5 | 2.5 | 2.4 | 2.3 |
| | g | 2.0 | 2.0 | 2.1 | 2.0 | 2.3 | 2.4 | 2.4 | 2.3 | 2.3 |
| | r | 1.8 | 1.8 | 1.8 | 1.8 | 2.0 | 2.2 | 2.3 | 2.2 | 2.1 |
| RMS | b | 48 | 48 | 48 | 46 | 44 | 42 | 43 | 43 | 43 |
| | g | 34 | 34 | 33 | 34 | 31 | 29 | 28 | 24 | 24 |
| | r | 30 | 27 | 30 | 30 | 25 | 24 | 23 | 23 | 20 |
| Residual Ag | | 2.2 | 1.8 | 2.2 | 2.2 | 1.6 | 1.0 | 1.1 | 0.9 | 0.6 |

As shown in Table 2, as compared with the sample 1 using a color forming coupler outside the scope of this invention the respective samples 2, 3, 4 in which color forming couplers according to this invention are used alone, the improved effect can be recognized but it is not great. In contrast, in the sample 5 in which 3 kinds of the couplers according to this invention are used in combination in the low sensitive layer improved effects of LES and RMS as unexpected from samples 2, 3 and 4 could be obtained.

That is, latitude was broadened and graininess was also improved, with residual Ag quantity being also small.

In samples 6 and 7 in which the color forming couplers were all replaced with the color forming couplers according to this invention, synergetic effects can be recognized in all of LES, RMS and residual Ag.

Such an improved effect can be also seen in samples 8 and 9 in which only 1 kind of emulsion was contained in the low sensitive layer. However, in usual practice, for the necessity of making broad latitude by mixing emulsions it has been difficult to improve graininess namely to make the RMS value lower. Whereas, by use in combination with the constitution of this invention it has become possible to have high graininess and broad latitude and further to increase processing stability.

Also, in a sample having a layer constitution of Pro, BH, IL, GH, IL, RH, IL, BL, IL, GL, RL and BS, similar effects with high sensitivity could be recognized.

As described above, according to this invention, it is possible to obtain a light-sensitive material which has broad exposure latitude and is excellent in gradation characteristic, or a light-sensitive material which has broad exposure latitude and is excellent in graininess, or a light-sensitive material which has broad exposure latitude, is excellent in graininess and also good in a desilverization performance during processing.

We claim:

1. A light-sensitive silver halide color photographic material comprising a light-sensitive multi-layer color photographic material having at least one blue-sensitive layer, one green-sensitive layer and one red-sensitive layer on a support, wherein;

at least one blue-sensitive layer contains at least one kind of benzoylacetanilide type benzoyl coupler, at least one green-sensitive layer contains at least one kind of pyrazolotriazole type coupler, and at least one red-sensitive layer contains at least one kind of phenyl ureido type coupler, wherein said phenyl ureido type coupler is a phenol type cyan color forming coupler having at the 2-position a phenylureido group, and at the 5-position an acylamino group;

said phenylureido type coupler being represented by the formula (XIII a);

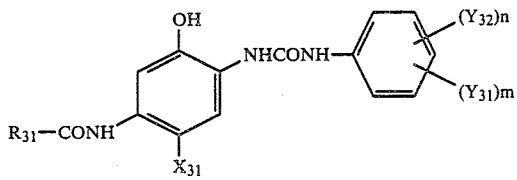

wherein, $R_{31}$ represents an alkyl group having 4 to 30 carbon atoms, aryl group or heterocyclic group; $Y_{31}$ represents trifluoromethyl, nitro, halogen atom, cyano group or a group represented by $—COR_{30}$, $—COOR_{30}$, $—SO_2R_{30}$, $—SO_2OR_3$

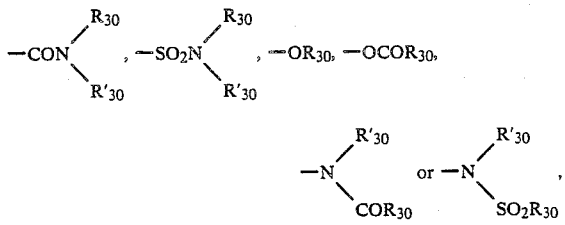

wherein $R_{30}$ represents an aliphatic group or an aromatic group, and $R'_{30}$ represents a hydrogen atom or a group represented by $R_{30}$;

$Y_{32}$ represents a monovalent group; m represents an integer from 1 to 3, and n is an integer from 0 to 3, with the proviso that $m+n \leqq 5$; and $X_{31}$ represents a hydrogen atom or an eliminable group during the coupling reaction with the oxidized product of a color developing agent.

2. The light-sensitive silver halide color photographic material according to claim 1, wherein said benzoyl coupler is a yellow color forming coupler represented by the formula shown below:

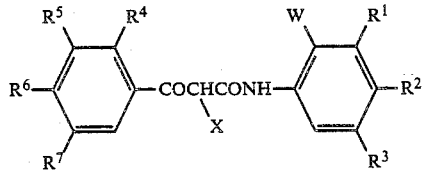

wherein $R^1$, $R^2$ and $R^3$ are the same or different, and each represent a hydrogen atom, a halogen atom, an alkyl group, an aryl group, an alkoxy group, an acylamino group, a carbamoyl group, an alkoxycarbonyl group, a sulfonamide group or a sulfamoyl group;

$R^4$, $R^5$, $R^6$ and $R^7$ are the same or different, and each represent a hydrogen atom, an alkyl group, an alkoxy group, an aryloxy group, an acylamino group, or a sulfonamide group;

W represents a halogen atom, an alkyl group, an alkoxy group, an aryloxy group or a dialkylamino group; and X represents a hydrogen atom or an eliminable group.

3. The light-sensitive silver halide color photographic material according to claim 1, wherein pyrazolotriazole type coupler is a magenta color forming coupler represented by the formula shown below:

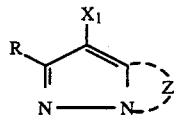

wherein

Z represents a group of non-metal atoms necessary for formation of a nitrogen-containing heterocyclic ring;

$X_1$ represents a hydrogen atom or a substituent eliminable through the reaction with the oxidized product of a color developing agent; and R represents a hydrogen atom or a substituent.

4. The light-sensitive silver halide color photographic material according to claim 1, wherein said light-sensitive multi-layer color photographic material comprises each two or three layers of blue-sensitive layer, green-sensitive layer and red-sensitive layer, and these layers have lower sensitivity as they are positioned nearer to the support.

5. The light-sensitive silver halide color photographic material according to claim 1, wherein said couplers are contained in an amount of $2\times10^{-3}$ to $5\times10^{-1}$ mol per mol of the light-sensitive silver halide contained in the layers.

6. The light-sensitive silver halide color photographic material according to claim 5, wherein said couplers are contained in an amount of from $1\times10^{-2}$ to $1\times10^{-1}$ mol per 1 mol of the silver halide in a high sensitive layer, from $1\times10^{-2}$ to $1\times10^{-1}$ mol per 1 mol of the silver halide in a medium sensitive layer and from $2\times10^{-2}$ to $2\times10^{-1}$ mol per 1 mol of the silver halide in a low sensitive layer.

7. The light-sensitive silver halide color photographic material according to claim 1, wherein said couplers are contained in an amount of 50% or more based on the total couplers contained in the same color-sensitive layer.

8. The light-sensitive silver halide color photographic material according to claim 3, wherein said magenta color forming coupler is represented by the formula (VI):

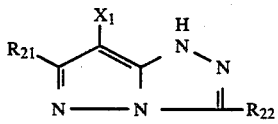

wherein $R_{21}$ and $R_{22}$ have the same meanings as R, and $X_1$ has the same meaning as $X_1$.

9. The light-sensitive silver halide color photographic material according to claim 3, wherein said magenta color forming coupler is contained in an amount of from $1\times10^{-3}$ to 1 mol per 1 mol of the silver halide contained in the green-sensitive layer.

10. The light-sensitive silver halide color photographic material according to claim 1, wherein the mean grain size of the silver halide contained in at least one of a high sensitive layer of the green-sensitive silver halide layers and a high sensitive layer of the red-sensitive silver halide layers is within the range of from 0.40 to 3.00 μm.

11. The light-sensitive silver halide color photographic material according to claim 1, wherein the mean grain size of the silver halide contained in at least one of a low sensitive layer of the green-sensitive silver halide layers and a low sensitive layer of the red-sensitive silver halide layers is within the range of from 0.20 to 1.50 μm.

12. The light-sensitive silver halide color photographic material according to claim 4, wherein a light-sensitive silver halide emulsion contained in at least one of a low sensitive layer of the green-sensitive silver halide layers and a low sensitive layer of the red-sensitive silver halide layers comprises substantially one kind of mono-dispesed silver halide emulsion.

13. The light-sensitive silver halide color photographic material according to claim 1, wherein photographic material further comprises a non-diffusive coupler capable of forming a diffusive dye appropriately blurring a dye image through the reaction with the oxidized product of a color developing agent and is represented by the formula (A):

$$(\overline{Cp})_aX$$

wherein Cp represents a coupler diffusible for improvement of graininess by giving rise appropriately blurring of color imege, X represents a group eliminable through the reaction with the oxidated product of a color developing agent bonded to the coupler component at the coupling position and is a component containing a ballast group having 8 to 32 carbon atoms, and a represents 1 or 2.

14. The light-sensitive silver halide color photographic material according to claim 1, wherein said light-sensitive multi-layer color photographic material comprises each plural layers of blue-sensitive layers, green-sensitive layers and red-sensitive layers, said layers have different sensitivities, at least one of said layers having different sensitivities contains monp-dispersed emulsion.

15. The light-sensitive silver halide color photographic material according to claim 14, wherein said mono-dispersed emulsion contains grains having grain size distribution represented by the following equations:

$$\frac{s}{\bar{r}} \leqq 0.20 \text{ and } \bar{r} = \frac{\Sigma ni \cdot ri}{\Sigma ni}$$

wherein s represents standard deviation of grain size distribution of the light-sensitive silver halide, and $\bar{r}$ represents mean grain size thereof.

16. The light-sensitive silver halide color photographic material according to claim 15, wherein $$\frac{s}{\bar{r}} \leqq 0.15.$$

17. The light-sensitive silver halide color photographic material according to claim 14, wherein said layers other than the highest sensitive layers for each color contains mono-dispersed emulsion.

18. The light-sensitive silver halide color photographic material according to claim 17, wherein said mono-dispersed emulsion contains grains having grain size distribution represented by the following equations:

$$\frac{s}{\bar{r}} \leqq 0.20 \text{ and } \bar{r} = \frac{\Sigma ni \cdot ri}{\Sigma ni}$$

wherein s represents standard deviation of grain size distribution of the light-sensitive silver halide, and $\bar{r}$ represents mean grain size thereof.

19. The light-sensitive silver halide color photographic material according to claim 18, wherein $$\frac{s}{\bar{r}} \leqq 0.15.$$

20. The light-sensitive silver halide color photographic material according to claim 1, wherein each of the blue-sensitive, green-sensitive and red sensitive layers comprises plural layers, and the benzoylacetanilide type benzoyl coupler, the pyrazolotriazole type coupler and the phenyl ureido type coupler are contained in the low sensitive layer of each of the blue-sensitive and red-sensitive layers respectively.

21. The light-sensitive silver halide color photographic material according to claim 1, wherein each of the blue-sensitive, green-sensitive and red-sensitive layers comprises plural layers and at least one low sensitive layer of the blue-sensitive, green-sensitive and red-sensitive layers consists of one kind of an emulsion.

22. The light-sensitive silver halide color photographic material according to claim 21, wherein low sensitive layers of the blue-sensitive, green-sensitive and red-sensitive layers consist of one kind of an emulsion.

23. The light-sensitive silver halide color photographic material according to claim 20, wherein at least one low sensitive layer of the blue-sensitive, green-sensitive and red-sensitive layers consists of one kind of an emulsion.

24. The light-sensitive silver halide color photographic material according to claim 20, wherein low sensitive layers of the blue-sensitive, green-sensitive and red-sensitive layers consist of one kind of an emulsion.

* * * * *